US011918087B2

(12) United States Patent
Chambers et al.

(10) Patent No.: US 11,918,087 B2
(45) Date of Patent: Mar. 5, 2024

(54) CORD LOCK APPARATUS AND BELT WITH SAME

(71) Applicant: LT Brands, Inc., Morgantown, WV (US)

(72) Inventors: Justin Ronald Chambers, Morgantown, WV (US); Ephraim Pittore-Candelario, Morgantown, WV (US)

(73) Assignee: LT BRANDS, INC., Morgantown, WV (US)

( * ) Notice: Subject to any disclaimer, the term of this patent is extended or adjusted under 35 U.S.C. 154(b) by 0 days.

(21) Appl. No.: 17/025,612

(22) Filed: Sep. 18, 2020

(65) Prior Publication Data

US 2021/0076782 A1 Mar. 18, 2021

Related U.S. Application Data

(60) Provisional application No. 62/901,946, filed on Sep. 18, 2019.

(51) Int. Cl.

| | |
|---|---|
| ***A44B 11/04*** | (2006.01) |
| ***A41F 9/00*** | (2006.01) |
| ***A44B 13/00*** | (2006.01) |

(52) U.S. Cl.

CPC ..... *A44B 11/04* (2013.01); *A41F 9/002* (2013.01); *A44B 13/0058* (2013.01)

(58) Field of Classification Search

CPC ..... A44B 11/04; A44B 13/0058; A44B 99/00; A41F 9/002; A41F 9/025; F16G 11/146; F16G 11/00; F16G 11/06; F16G 11/106; Y10T 24/3916; F16B 11/04; F16B 11/046

See application file for complete search history.

(56) References Cited

U.S. PATENT DOCUMENTS

| | | | | |
|---|---|---|---|---|
| 150,988 | A | 5/1874 | Edward | |
| 179,168 | A | 6/1876 | Dunn | |
| 189,274 | A | 4/1877 | Smith | |
| 366,971 | A * | 7/1887 | Michaelis | F16G 11/00 24/129 R |
| 1,069,135 | A | 9/1913 | Heberling | |

(Continued)

FOREIGN PATENT DOCUMENTS

| | | |
|---|---|---|
| GB | 754786 | 8/1956 |
| WO | 2020154469 | 7/2020 |

OTHER PUBLICATIONS

Anonymous, "APIA Mens Womens Thimble Charm Bracelets Paracord Rope Wristbands Blac—Fathom Bracelets", Fathom, https://fathombracelets.com/products/apia-mens-womens-thimble-charm-bracelets-paracord-rope-wristbands-black-grey, accessed Jan. 17, 2020, 4 pages.

(Continued)

*Primary Examiner* — Robert Sandy
*Assistant Examiner* — Rowland Do
(74) *Attorney, Agent, or Firm* — Andrew D. Wright; Calderon Safran & Cole, P.C

(57) ABSTRACT

An article of clothing in the form of a belt includes: a cord having a proximal end and a distal end; and a buckle having an eyelet and a locking feature; wherein the buckle is attached to the proximal end and the distal end of the cord is configured to pass through the buckle eyelet; and the locking feature is structured and arranged to selectively lock and unlock movement of the cord through the buckle.

20 Claims, 34 Drawing Sheets

(56) References Cited

U.S. PATENT DOCUMENTS

| | | | | |
|---|---|---|---|---|
| 1,075,179 | A | 10/1913 | Westberg | |
| D111,615 | S | 10/1938 | Richtmyer et al. | |
| 2,322,869 | A | 6/1943 | Mohr | |
| 2,845,674 | A * | 8/1958 | Pearson | F16G 11/106 24/134 R |
| 3,068,316 | A | 6/1959 | Witt | |
| 3,161,890 | A | 12/1964 | Betz | |
| 3,163,902 | A | 1/1965 | Bernburg et al. | |
| 3,358,338 | A | 12/1967 | Clasen | |
| 4,878,270 | A * | 11/1989 | Westerkamp | F16G 11/04 24/132 R |
| 5,415,658 | A * | 5/1995 | Kilpela | A61B 17/842 606/300 |
| 5,568,952 | A * | 10/1996 | Ruegg | B65D 63/1081 292/307 A |
| 5,852,853 | A * | 12/1998 | Pennoyer, Jr. | F16G 11/106 24/134 P |
| 5,950,284 | A | 9/1999 | Persson | |
| 6,077,268 | A * | 6/2000 | Farris | A61B 17/8861 606/103 |
| 6,269,523 | B1 * | 8/2001 | Benoit | F16G 11/14 24/130 |
| 6,278,061 | B1 * | 8/2001 | Daoud | H02G 3/22 439/604 |
| 6,345,418 | B1 | 2/2002 | Bertrand et al. | |
| 7,579,556 | B2 * | 8/2009 | Tapper | H02G 3/088 16/2.1 |
| 7,833,227 | B2 * | 11/2010 | Fernandez | A61B 17/82 24/130 |
| D767,250 | S | 9/2016 | Poggi | |
| 9,808,050 | B2 * | 11/2017 | Ben-Arie | A43C 7/04 |
| 10,051,925 | B2 * | 8/2018 | Fennell | A44B 18/0069 |
| 10,072,731 | B2 * | 9/2018 | Kingery | F16G 11/12 |
| 10,309,443 | B1 * | 6/2019 | Driver | F16G 11/04 |
| 10,390,590 | B2 * | 8/2019 | Ben-Arie | A43C 11/20 |
| 11,344,085 | B2 * | 5/2022 | Chambers | A41F 9/002 |
| 2005/0155194 | A1 | 7/2005 | Christiansson | |
| 2009/0249586 | A1 * | 10/2009 | Brown | F16G 11/106 24/115 M |
| 2010/0175732 | A1 * | 7/2010 | Ma | F16G 11/103 135/161 |
| 2011/0017249 | A1 * | 1/2011 | Ma | F16G 11/106 135/15.1 |
| 2011/0052314 | A1 | 3/2011 | Lindsey | |
| 2011/0056050 | A1 * | 3/2011 | Hassing | F16G 11/101 24/132 R |
| 2012/0042494 | A1 | 2/2012 | Fay | |
| 2018/0242668 | A1 | 8/2018 | Earnshaw | |
| 2019/0223531 | A1 | 7/2019 | Alekseev | |
| 2020/0229548 | A1 | 7/2020 | Chambers et al. | |
| 2021/0330043 | A1 * | 10/2021 | Kingwill | F16G 11/106 |

OTHER PUBLICATIONS

Anonymous, "Quick Grip and Release Rope Belt", Etsy, https://www.etsy.com/sg-en/listing/579172324/quick-grip-and-release-rope-belt?ga_order=most_relevant&ga_search_type=all&ga_view_type=gallery&%E2%80%A6, accessed Jan. 17, 2020, 2 pages.

Robson, "Lash Thimbles—What are they, and how do I use them?", https://www.sail-worldcruising.com/news/215523/Lash-Thimbles, Mar. 25, 2019, 4 pages.

Anonymous, "Climbing Rope Belt—Festive", https://www.changingtides.global/products/climbing-rope-belt-festive, accessed Jan. 17, 2020, 4 pages.

Anonymous, "Belt size M (approx. 115 cm) with ring closure, upcycling from a disused climbing rope", Etsy, https://www.etsy.com/sg-en/listing/722359247/belt-size-m-approx-115-cm-with-ring, accessed Jan. 17, 2020, 4 pages.

Anonymous, "30mm—Millennium™ Black Buckle", https://bisondesigns.com/products/30mm-millennium™-black-buckle, Bison Designs, accessed Jan. 20, 2020, 2 pages.

Anonymous, "Sports Belt 3/4" w/ Plastic Cam Buckle & Lightweight Polypropylene", https://www.strapworks.com/ProductDetails.aspProductCode=SBPC34L&gclid=EAIaIQobChMIkvTWusWS5wIVh5WzCh089AksEAQYCSABEgIXT_D_BwE, accessed Jan. 20, 2020, 4 pages.

Anonymous, "Trackside Wheel Tie-Down Strap", https://www.revzilla.com/motorcycle-tires, Revzilla, accessed Jan. 20, 2020, 1 page.

Anonymous, "PRO-ROD—Thimbles DIN 3091", https://www.prolift-lifting.com/products/thimbles-pro-rod, PROlift, accessed Jan. 20, 2020, 2 pages.

Anonymous, "Netform™ Steel Reinforced Rope", https://incord.com/, Incord, accessed Jan. 20, 2020, 15 pages.

Anonymous, "Patagonia Friction Belt", https://www.graffitishop.net/Patagonia-Friction-Belt-Black-59178-blk-Belts-Accessories-id130887, Graffitishop, accessed Jan. 20, 2020, 1 page.

Office Action dated Mar. 19, 2021 for U.S. Appl. No. 16/750,551, 11 pages.

Final Office Action dated Sep. 24, 2021 for U.S. Appl. No. 16/750,551, 11 pages.

Notice of Allowance dated Janaury 20, 2022 for U.S. Appl. No. 16/750,551, 10 pages.

Anonymous, "DDY Ultralight Aluminum Guyline Cord Adjuster for Tent Camping Hiking Backpacking Outdoor Activity" https://www.amazon.com/DDY-Ultralight-Aluminum-Adjuster-Backpacking/dp/B013FOVIGC/ , accessed Sep. 9, 2022, 7 pages.

* cited by examiner

CORD LOCK APPARATUS AND BELT WITH SAME

FIELD OF THE INVENTION

Aspects of the invention generally relate to cord locking devices and articles of clothing including a cord and a cord locking device.

BACKGROUND

Traditional belts that are worn around the waist of a user are often ill-fitting, which can cause physical discomfort in the user. For example, a conventional belt with a buckle that engages one of plural holes in the belt strap is limited to a fixed number of discrete sizes that are defined by the different holes in the belt strap. This type of belt often results in a too tight or too loose fit on many users and does not allow easy adjustment on the go. Additionally, traditional belts can have straps and buckles that are bulky, have sharp edges, produce uncomfortable fits and further aspects that can be undesirable to the user.

SUMMARY

According to aspects of the invention, a cord lock apparatus includes a buckle that a single cord or multiple cords, if desired in the design, can pass through. Herein, the term cord may refer to a single cord or a plurality of cords. In one embodiment, the buckle includes an eyelet. The eyelet comprises an opening of symmetric or asymmetric geometries with a locking feature. One embodiment of the locking feature can comprise concentric teeth such that when the entry cord axis and eyelet axis approach a perpendicular orientation to each other, the teeth engage the cord. The engaging of the teeth locks the cord from moving through the eyelet. In another embodiment, the eyelet is devoid of teeth and instead has at least one edge that is used to selectively engage at least one cord to prevent movement of the cord through the eyelet. In a preferred embodiment, a combination of the buckle and a cord attached to the buckle are configured as an article of clothing, in particular a belt that is worn around the waist of a user, e.g., for holding garments such as pants, shorts, etc.

In a first aspect of the invention, there is an apparatus comprising: a buckle comprising an eyelet whereas the eyelet has teeth positioned at the eyelet openings configured to allow cord to pass through parallel to the central axis of the eyelet. In embodiments, the eyelet teeth are arranged in a concentric pattern at both eyelet openings. In embodiments the teeth are arranged around the perimeter of an asymmetric geometry making up the eyelet. In embodiments, the eyelet teeth engage a passing cord when the cord axis is positioned between a 15 degree and a 45 degree angle relative to the central axis of the eyelet.

In another aspect of the invention, there is an apparatus comprising: at least one cord with a fixed length having a proximal and distal end, wherein a buckle is attached to the proximal end and the proximal end is proximal to the buckle. In embodiments, the attachment creates a hinged attachment. The buckle has an eyelet comprising teeth positioned at the opening configured to allow the distal end of the cord to pass through parallel to the central axis of the eyelet. In embodiments, the cord is worn around the waist as a belt. In embodiments, the cord locks when the cord is perpendicular to the central axis of the eyelet. In embodiments, there is a range of angles at which the cord will start to lock relative the eyelet. In this regard, as a user starts to move the cord from the parallel position to the perpendicular position, the cord will start to engage the teeth at as little as a 15 degree angle. As the angle increases, the lock will become stronger and carry more tension before slipping. In embodiments, the cord can be cut to fit a specific waist size. In embodiments, the cord can be adjusted by the user by changing the angle for which the distal end of the cord is relative to the central axis of the buckle eyelet.

In another aspect of the invention, there is an apparatus including: at least one cord comprising a proximal end and a distal end; a buckle comprising an eyelet whereas the eyelet comprises an opening and a locking feature, wherein the proximal end of the cord is attached to the buckle; the distal end of the cord is configured to pass through the opening, wherein the cord and the buckle combine to form a continuous closed loop when the distal end of the cord is passed through the opening; and the locking feature is structured and arranged to selectively lock and unlock movement of the cord through the opening.

In another aspect of the invention, there is an apparatus including: a buckle comprising an eyelet; whereas the eyelet comprises a symmetric or asymmetric opening, and a locking feature, wherein the locking feature is structured and arranged to selectively lock and unlock movement of at least one cord through the opening; the buckle is a unitary structure and has no moving parts; and includes an additional opening to be used to attached to the proximal end of the cord via a loop fixed to the cord with methods such as sewing, adhesive, clamping, etc. This connection creates a hinged connection between the buckle and proximal end of the cord.

In another aspect of the invention, there is an apparatus including: at least one cord comprising a proximal end and a distal end; a buckle comprising an eyelet whereas the eyelet comprises at least one opening and a locking feature, wherein the proximal end of the cord is fixed to the buckle; the distal end of the cord is configured to pass through the opening, wherein the cord and the buckle combine to form a continuous closed loop when the distal end of the cord is passed through the opening; and the locking feature engages the cord and locks the cord relative to the eyelet when the cord is positioned within the opening with its long axis non-parallel to the axis of the opening. In embodiments, the buckle is fixed to the cord via a rigid connection.

In another aspect of the invention, there is an apparatus including: multiple cords comprising of proximal ends and distal ends; a buckle comprising an eyelet whereas the eyelet comprises at least one opening, whereas the opening comprises symmetric or asymmetric geometries, and a locking feature; wherein the proximal end of the cord is fixed to the buckle; the distal end of the cord is configured to pass through the opening, wherein the cord and the buckle combine to form a continuous closed loop when the distal end of the cord is passed through the opening; and the locking feature engages the cord and locks the cord relative to the buckle when the cord is positioned within the opening with its long axis non-parallel to an axis of the opening.

BRIEF DESCRIPTION OF THE SEVERAL VIEWS OF THE DRAWINGS

Aspects of the present invention are described in the detailed description which follows, in reference to the noted plurality of drawings by way of non-limiting examples of exemplary embodiments of the present invention.

DETAILED DESCRIPTION

Figure 1:
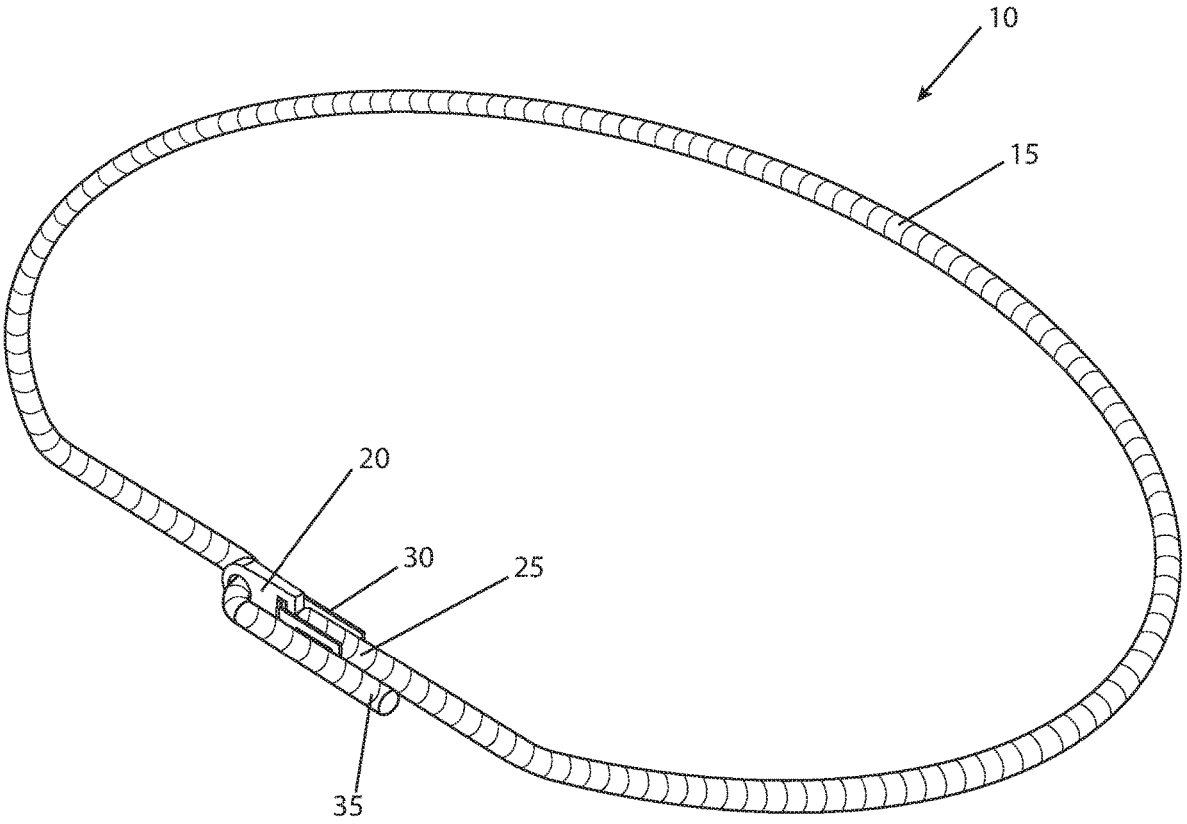
FIG. 1 shows a single cord belt comprising a lock apparatus in accordance with aspects of the invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of aspects of the present invention in more detail than is necessary for the fundamental understanding of the aspects of the present invention, the description taken with the drawings making apparent to those skilled in the art how the several forms of aspects of the present invention may be embodied in practice.

Aspects of the invention generally relate to cord locking devices and articles of clothing including a cord and a cord locking device. Embodiments of the invention include an apparatus to lock and unlock a cord or multiple cords and restrict the cord or multiple cords from moving. A first embodiment utilizes a buckle that includes an eyelet comprising of plural concentric teeth at each of the inlet and outlet of the eyelet. A second embodiment utilizes edges (e.g., ridges) at the inlet and outlet of the eyelet. In both embodiments, the buckle comprising the eyelet is secured to the proximal end, end proximal to the buckle, of at least one cord allowing the distal end of at least one cord to pass through the eyelet. The eyelet provides a releasable lock to the cord. As the cord passes through the eyelet parallel to the central axis of the eyelet, the eyelet allows the cord to pass freely. When the cord is turned to approach a perpendicular orientation to the eyelet axis the eyelet, the teeth or edges are engaged and this secures the cord from moving. The teeth or edges can engage the cord at a very low angle and as the angle increases so does the teeth/edge engagement resulting in higher tension capacities. The buckle comprising the eyelet can be maneuvered or positioned in various angles to adjust teeth/edge engagement and various cord slippage forces. Additionally, the buckle and eyelet can be designed or modified to meet a desired engagement angle, rope configuration or tension capacity. The buckle comprising the eyelet can be released by moving it towards the parallel position. The buckle comprising the eyelet can be reengaged by moving back toward the perpendicular position. The tension applied to the buckle by the distal end of the cord can also provide for self-locking or self-arresting buckle to the locking position. An embodiment of the buckle design requires no moving parts and allows for easy adjustment from the unlocked and locking position and anywhere in between.

A preferred embodiment uses the described buckle and cord as a belt to be worn around the waist of a user. In this embodiment, the buckle is secured to the proximal end of at least one cord, leaving the distal end of the cord available to go through the eyelet. This embodiment comprising a belt arrangement has the following features: it allows the cord to slide easily under compression but engage and lock under tension; it allows for multiple adjustable positions; it is releasably locking; and it can be designed to slip at a specific tension.

FIG. 1 shows a belt 10 comprising a lock apparatus in accordance with aspects of the invention. In embodiments, the belt 10 comprises a cord 15 attached to a buckle 20, with the buckle 20 functioning as the lock apparatus. As shown in FIG. 1 and subsequent figures, a proximal end 25 of the cord 15 is attached to the buckle 20. In embodiments, the buckle 20 is attached to the proximal end 25 by attachment 30, and a distal end 35 of the cord 15 is selectively passed through and locked in the buckle 20. As illustrated in FIG. 1, the cord 15 and the buckle 20 combine to form a continuous closed loop when the distal end 35 of the cord 15 is passed through an opening in the buckle 20. In this manner, the belt 10 can be worn around the waist of a user.

In embodiments, the cord 15 comprises an elongate flexible member such as a rope. In a particular embodiment, the cord 15 comprises a rope comprising a core and a sheath around the core. The cord 15 may be composed of any suitable materials, including without limitation: organic material (e.g., cotton, hemp, etc.), polymer material (e.g., nylon, dacron, etc.), and a mixture of organic and polymer materials. In an example embodiment, the cord 15 has a diameter of about 8 mm and a length of between 24 and 56 inches, although other diameters and lengths may be used in implementations of the invention. In a particular preferred embodiment, the cord 15 comprises an 8 mm diameter climbing rope comprising a core and a braided nylon sheath around the core, and has a length of between 24 and 56 inches.

According to aspects of the invention, the buckle 20 has an eyelet 50 for which the cord 15 passes through, an opening 55 structured and arranged to receive the attachment 30, and a locking feature that selectively locks and unlocks movement of the cord 15 through the circular opening. In one embodiment, the locking feature consists of teeth around the opening of the eyelet 50. In another embodiment, the locking feature consists of one or more sharp edges formed at the edges of the opening of the eyelet. In both embodiments, the eyelet 50 has only a single opening through which the cord 15 passes through only a single time. In both embodiments, the eyelet 50 is devoid of (i.e., does not include) moving parts. In embodiments, the attachment 30 comprises an element that passes through the opening 55 and is attached to the proximal end 25 of the cord 15, such that the proximal end 25 of the cord 15 is not directly attached to the buckle 20. In embodiments, the attachment 30 comprises a flexible element such as webbing, such as cotton and/or nylon webbing or similar material, that is looped through the opening 55 and that is connected to the proximal end 25 of the cord 15 by technique such as sewing, adhesive, clamp, etc. The opening and attachment 30 create a hinged connection between the buckle 20 and the proximal end 25 of the cord 15. In this manner, in embodiments the buckle is a unitary structure and has no moving parts and is attached to the proximal end of the cord via a hinged connection. Alternatively, in other embodiments, the attachment 30 and buckle 20 may be a rigid element, with or without a hinge, such as the buckle being an overmold on the proximal end of the cord, for example.

In embodiments, the buckle 20 comprises a unitary element composed of a single material. In one example, the buckle 20 is a unitary element composed of sturdy polymer, and is formed using molding, milling, or 3D printing techniques. In another example, the buckle 20 is a unitary element composed of metal or metal alloy, and is formed using forging, stamping, or milling techniques.

In embodiments, the distal end 35 is provided with an end termination that prevents fraying of the cord 15. In embodiments, the end termination is the same size or smaller than the outer diameter of the cord 15, so that the end termination and distal end of the cord is configured to pass through the opening in the eyelet 50. In one example, the end termination comprises a sleeve that compresses the tip of the distal end 35 of the cord 15 (the sleeve may be shrink fit, sewn, and/or adhered to the cord 15). In another example, the end termination comprises a melted portion of the sheath of the cord 15. In embodiments, in addition to having an end termination, the distal end 35 of the cord 15 is devoid of (i.e., does not have) any loops, knots, and rigging and/or connecting hardware. Such additional elements would prevent the distal end 35 from passing through the opening in the eyelet 50 in the manner described herein.

Figure 2:
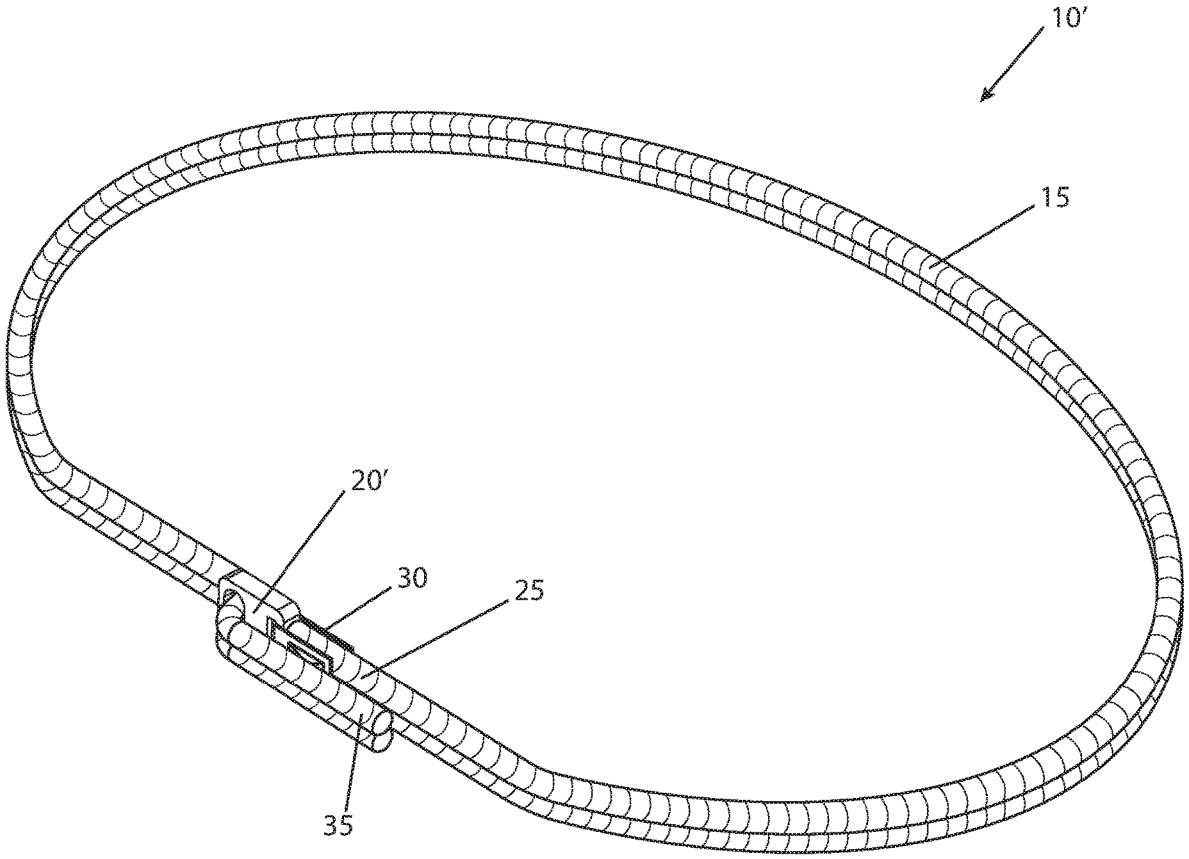
FIG. 2 shows a plural cord belt comprising a lock apparatus in accordance with aspects of the invention.

FIG. 2 shows another embodiment of the belt 10' in accordance with aspects of the invention. As shown in FIG. 2, the belt 10' comprises the cord 15, attachment 30, and buckle 20'. The cord 15 comprises a distal end 35 and a proximal end 25. Both the distal 35 end and proximal end 25 may be in the form of a cord termination as previously described or any other method know in the art. For example, the proximal end 25 or distal end 35 of cord 15 of belt 10' in embodiments can be a continuous loop bent to form the proximal end 25 or the distal end 35 of cord 15 and continuing as a second cord.

In embodiments, the buckle 20' is similar to the buckle 20 except that buckle 20' has an eyelet 50 that is sized and shaped to correspond to more than one portion of cord 15. In the example shown in FIGS. 2, 5, and 6, the belt 10' comprises a double-portion of cord 15, and the buckle 20' has an eyelet 50 that is sized and shaped to receive the double-portion of cord 15, and to selectively lock the double-portion of cord 15, in a similar manner as that described with respect to buckle 20 that is configured to be used with a single portion of cord 15.

FIGS. 7-12 show an embodiment of the belt 10 and 10' in accordance with aspects of the invention. As shown in FIGS. 7-12, the belt 10 and 10' comprises the cord 15, attachment 30, and buckle 20 and 20'.

Figure 3:
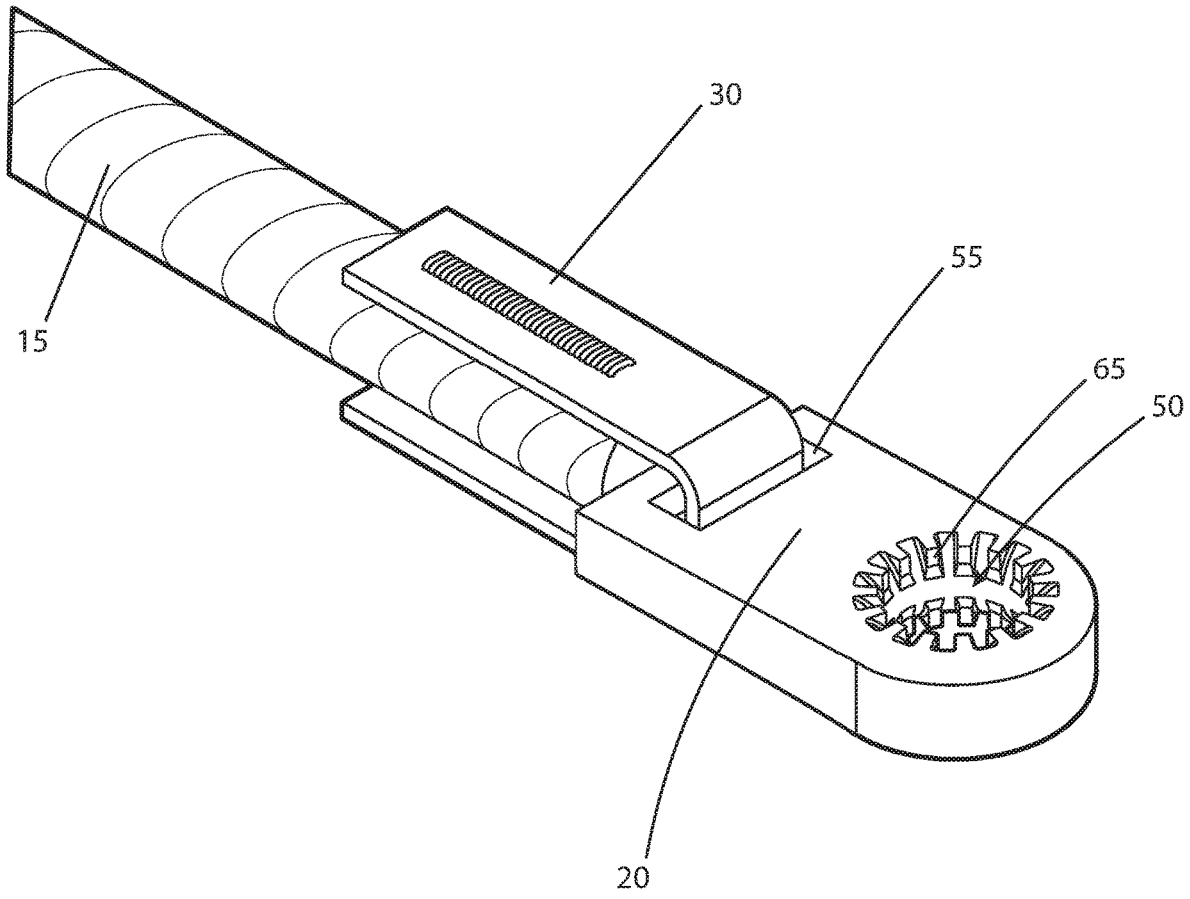
FIGS. 3-4 show a perspective view and front view respectively of the belt of FIG. 1 using a first buckle.
Figure 4:
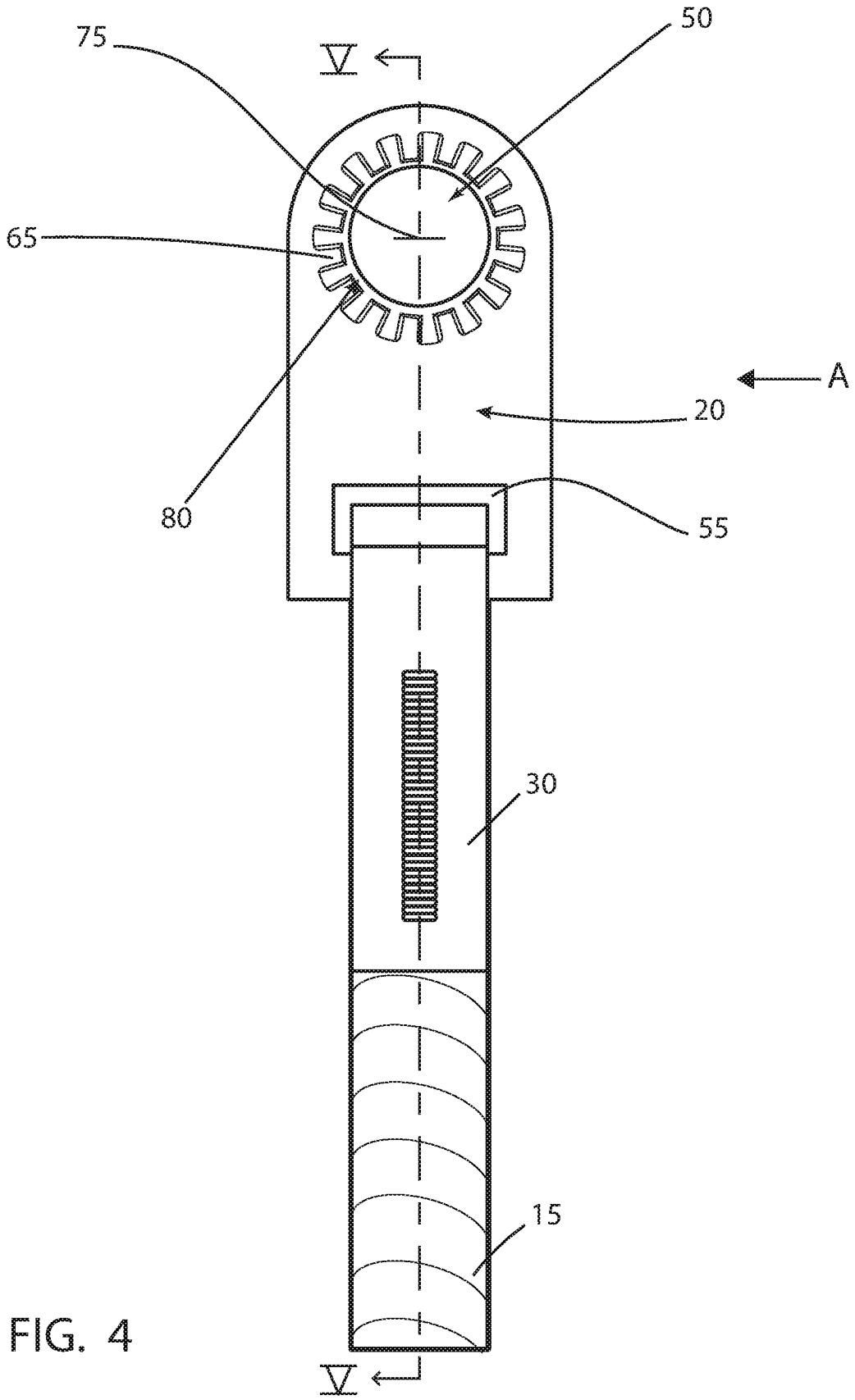

FIG. 3 shows a perspective view of a portion of the belt 10 including the buckle 20 and buckle attachment 30. FIG. 4 shows a front view of the portion of the belt 10.

Figure 5:
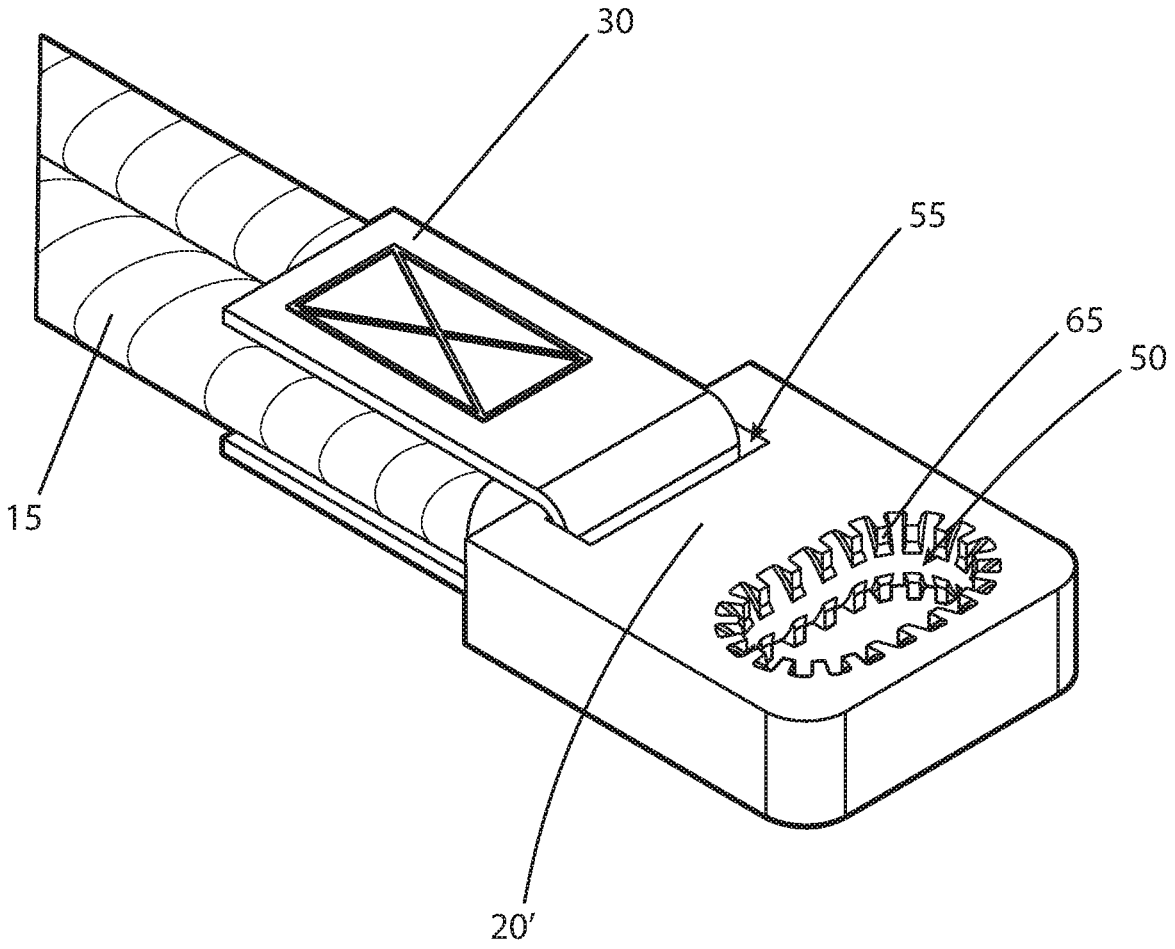
FIGS. 5-6 show a perspective view and front view respectively of the belt of FIG. 2 using a second buckle.
Figure 6:
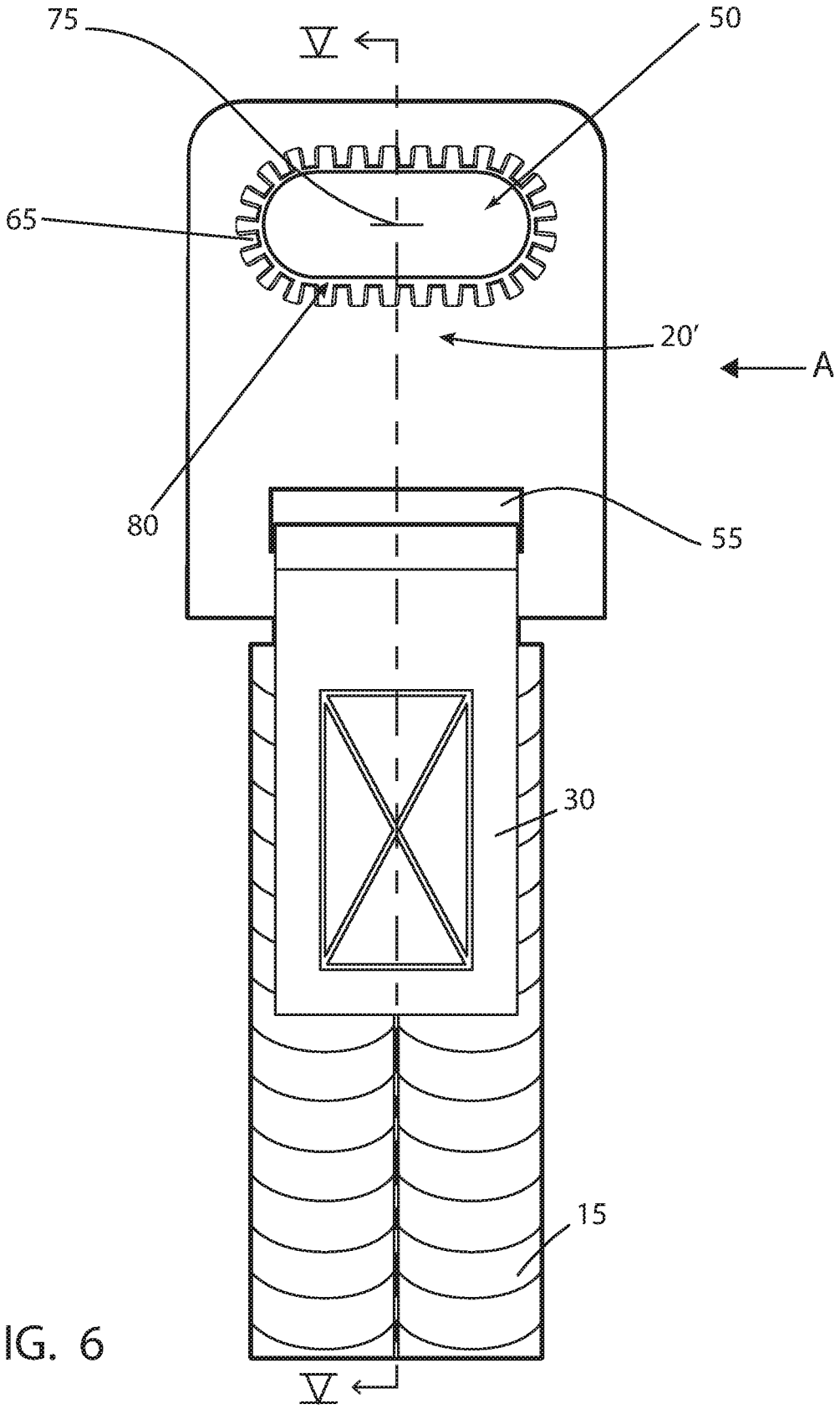

FIG. 5 shows a perspective view of a portion of the belt 10' including the buckle 20' and buckle attachment 30. FIG. 6 shows a front view of the portion of the belt 10'.

Figure 7:
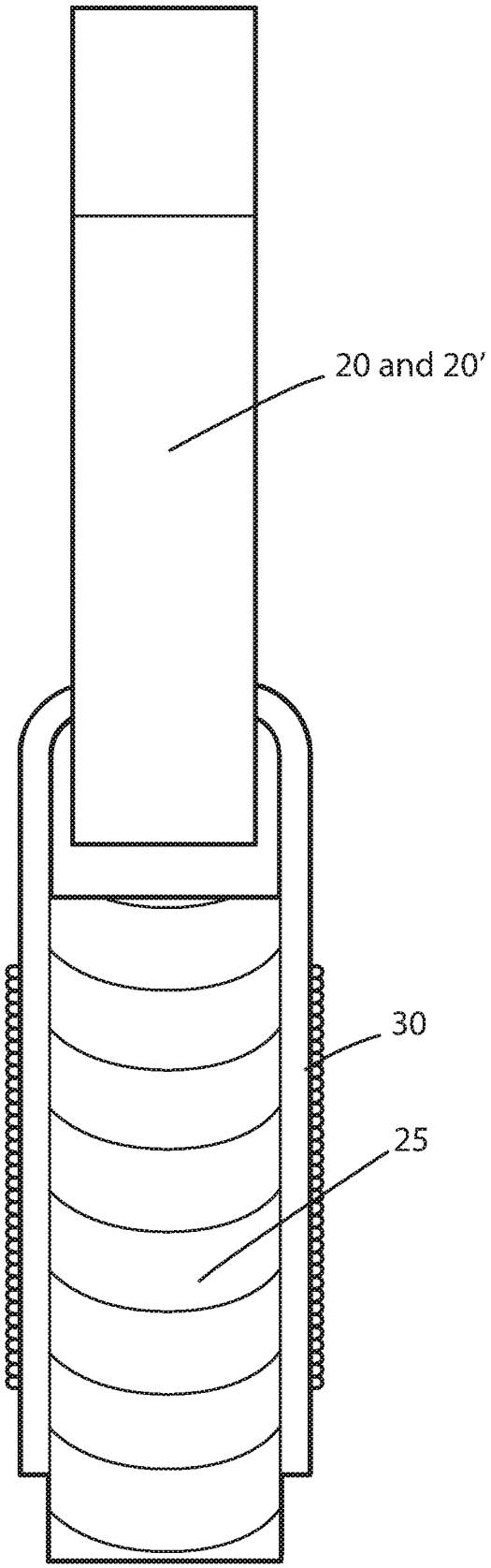
FIGS. 7-12 show aspects of buckles that may be used with the belt of FIG. 1 or the belt of FIG. 2.
Figure 8:
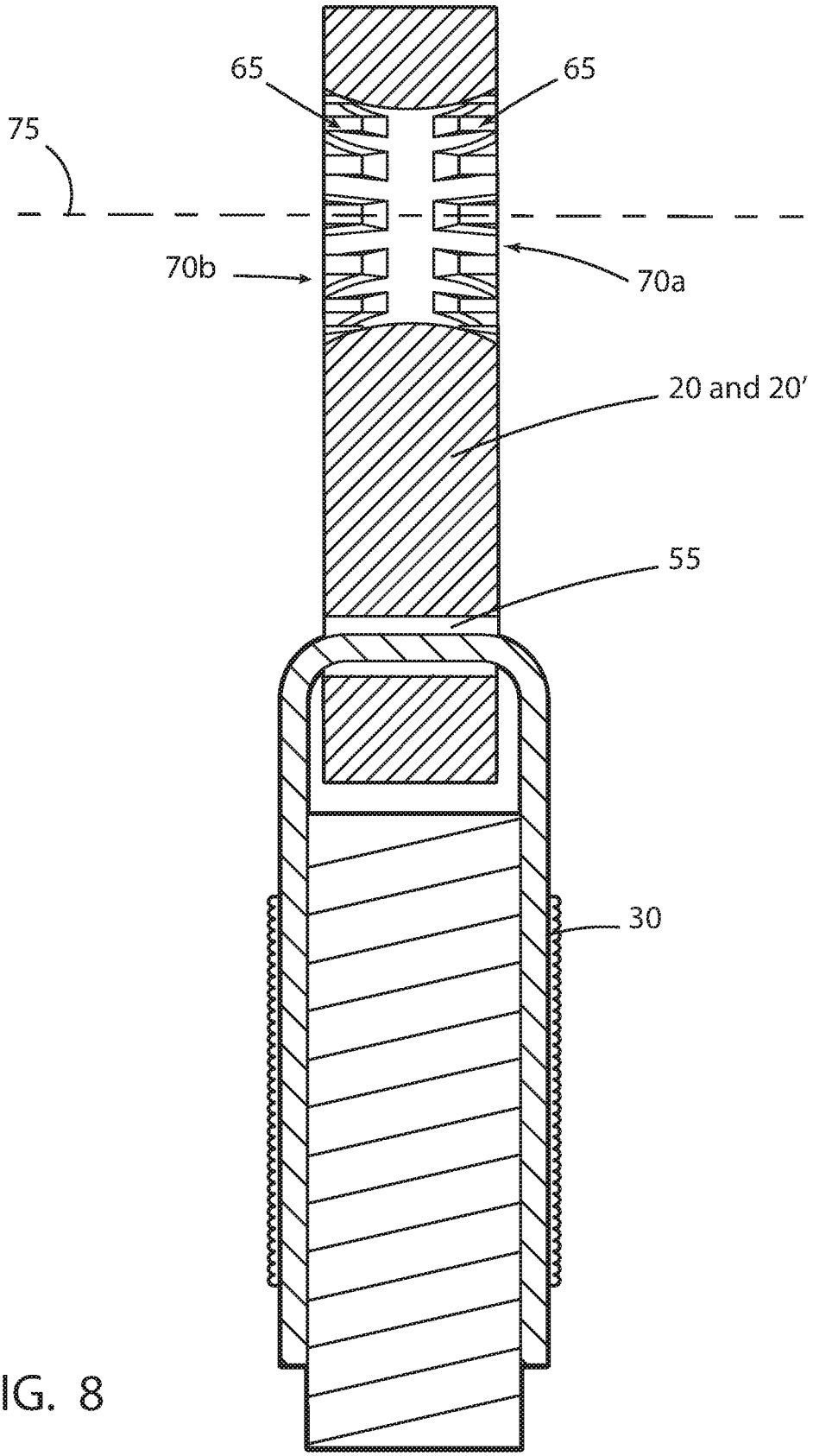

FIG. 7 shows a side view of the portion of the belt looking the direction of arrow A shown in FIG. 4 and FIG. 6, without the distal 35 end of the cord 15 passing though the buckle eyelet 50. FIG. 8 shows a side cutaway view of the portion of the belt 10 and belt 10' along line V-V of FIG. 4 and FIG. 6.

Figure 9:
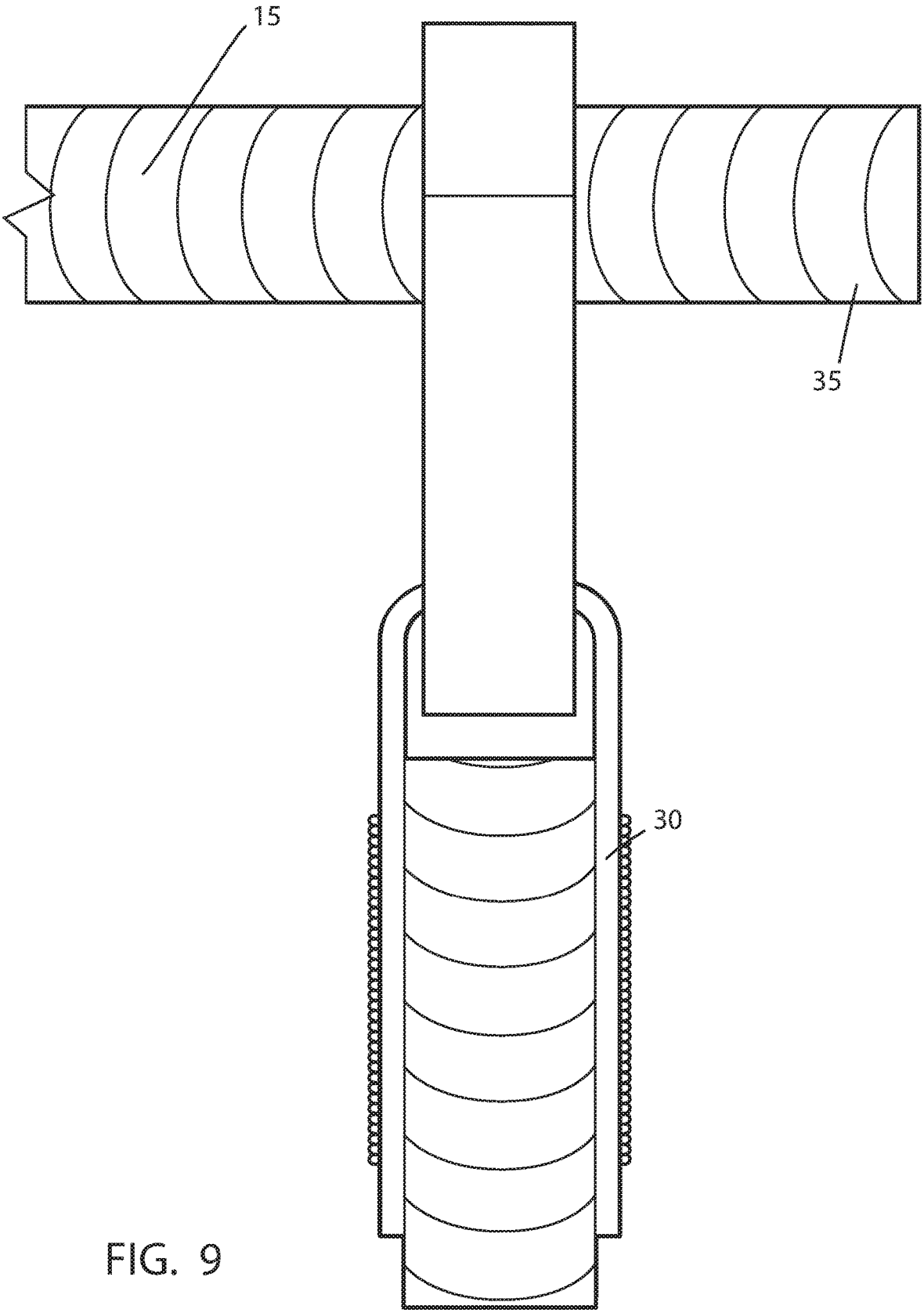

FIG. 9 shows a side view of the portion of the belt 10 and belt 10', with the distal end 35 of the cord 15 passing though the eyelet 50 in an unlocked position. The view shown in FIG. 9 is along the same direction as the view of FIG. 7.

Figure 10:
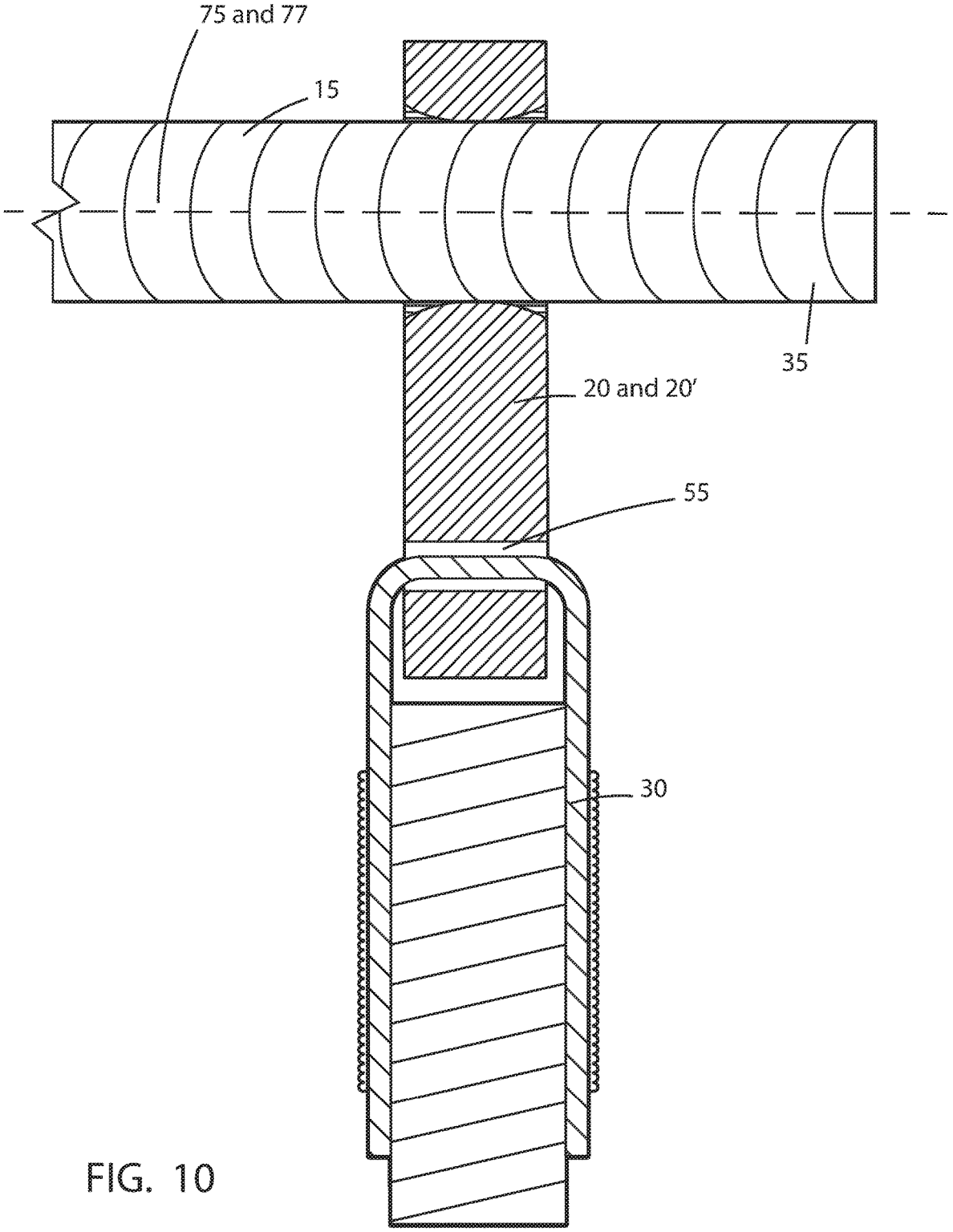

FIG. 10 shows a side cutaway view of the portion of the belt 10 and belt 10' of FIG. 9 with the distal end 35 of the cord 15 passing though the eyelet 50 in the unlocked position. The view shown in FIG. 10 is along the same direction and cutaway plane as the view of FIG. 8.

Figure 11:
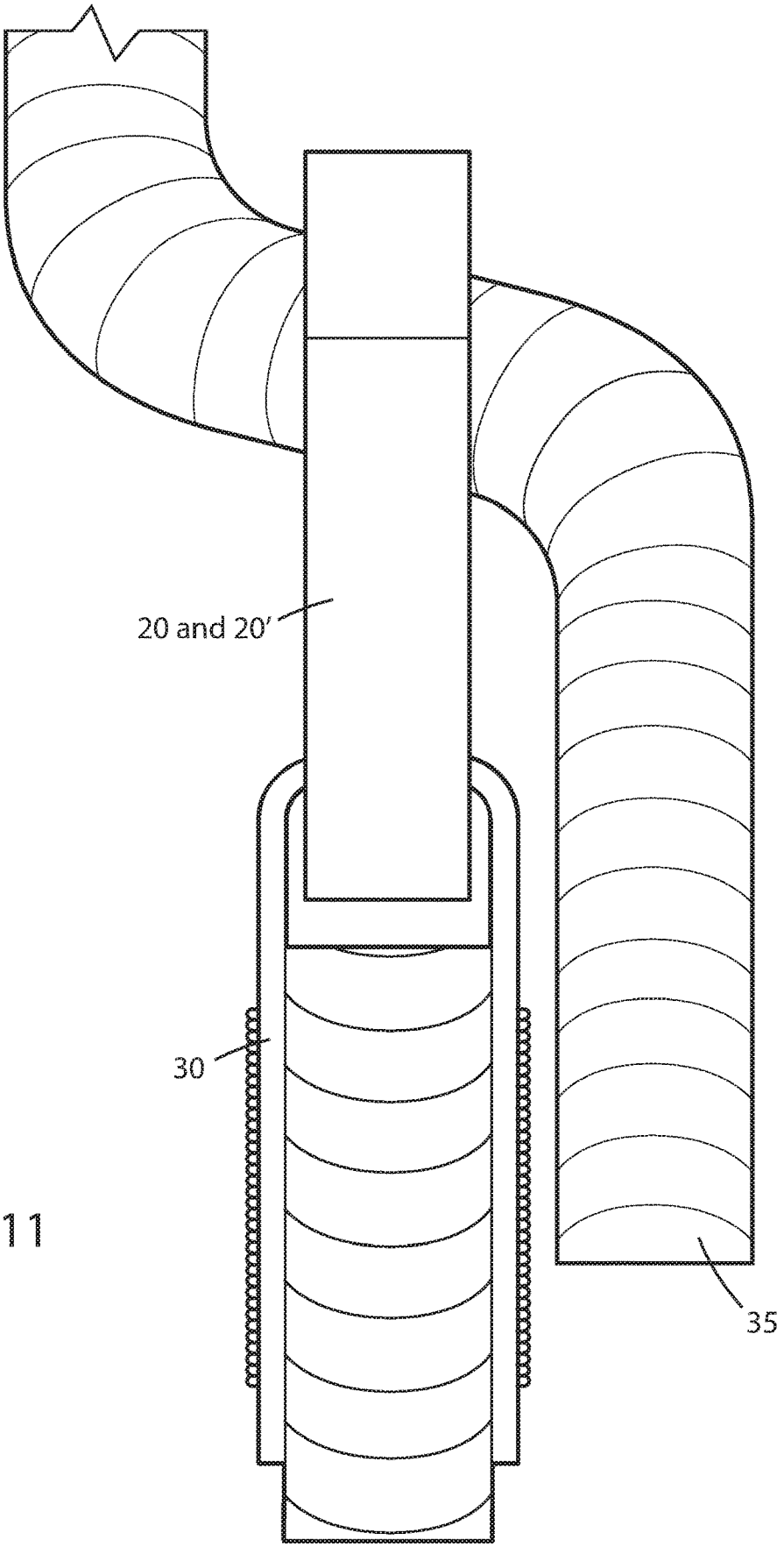

FIG. 11 shows a side view of the portion of the belt 10 and belt 10' with the distal end 35 of the cord 15 passing though the eyelet 50 and bent in a locked position. The view shown in FIG. 11 is along the same direction as the view of FIG. 9.

Figure 12:
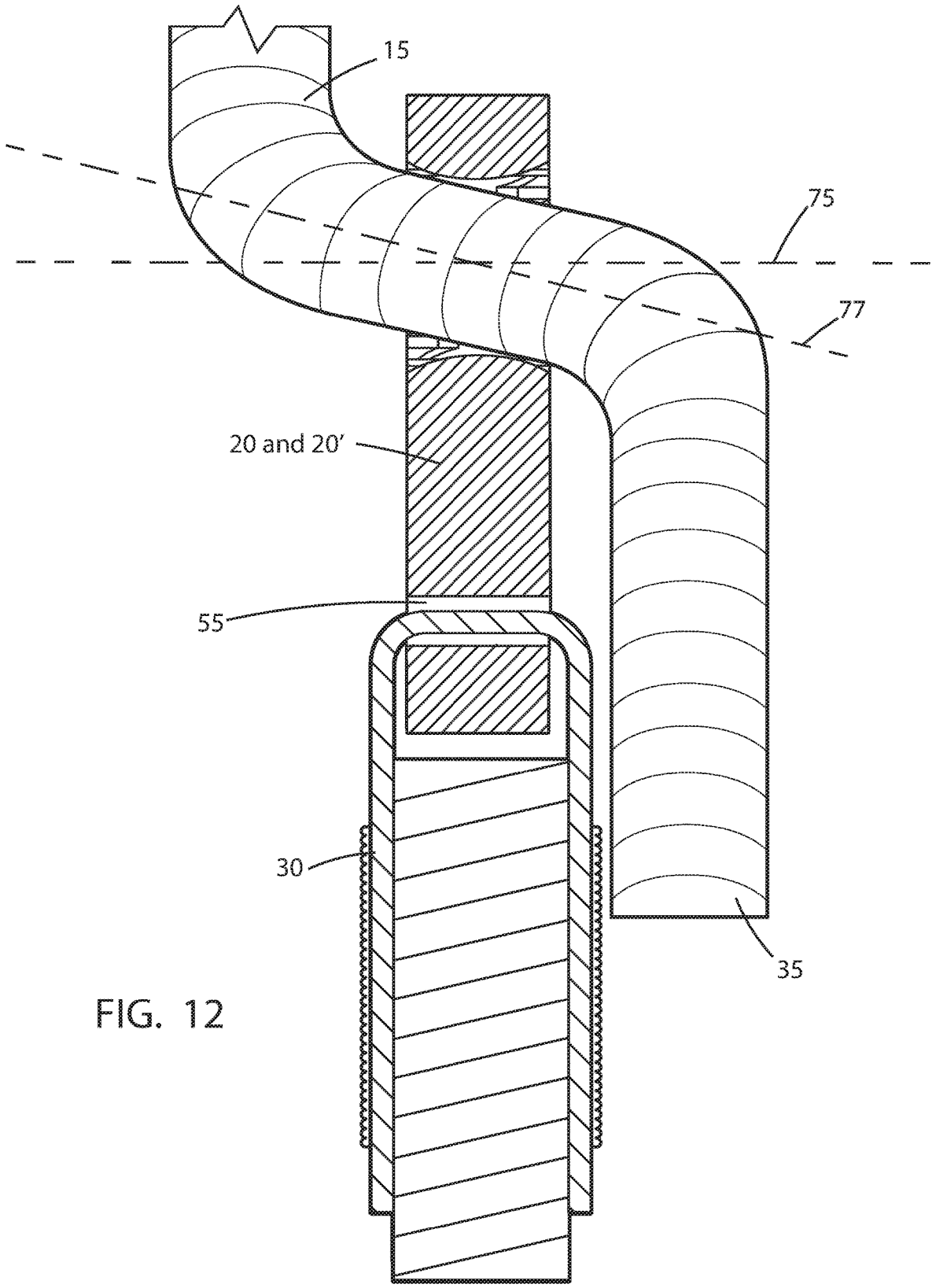

FIG. 12 shows a side cutaway view of the portion of the belt 10 and belt 10' with the distal end 35 of the cord 15 passing though the eyelet 50 and bent in the locked position. The view shown in FIG. 12 is along the same direction and cutaway plane as the view of FIG. 10.

Figure 13:
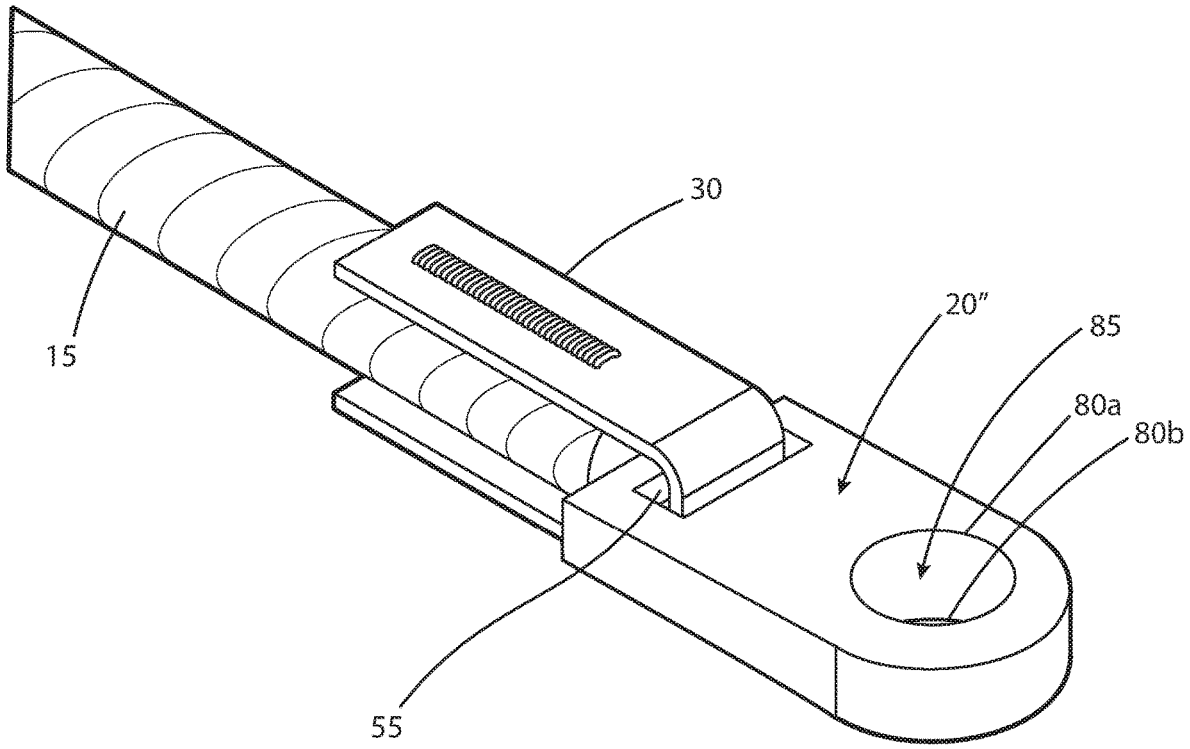
FIGS. 13-14 show a perspective view and front view respectively of the belt of FIG. 1 using a third buckle.
Figure 14:
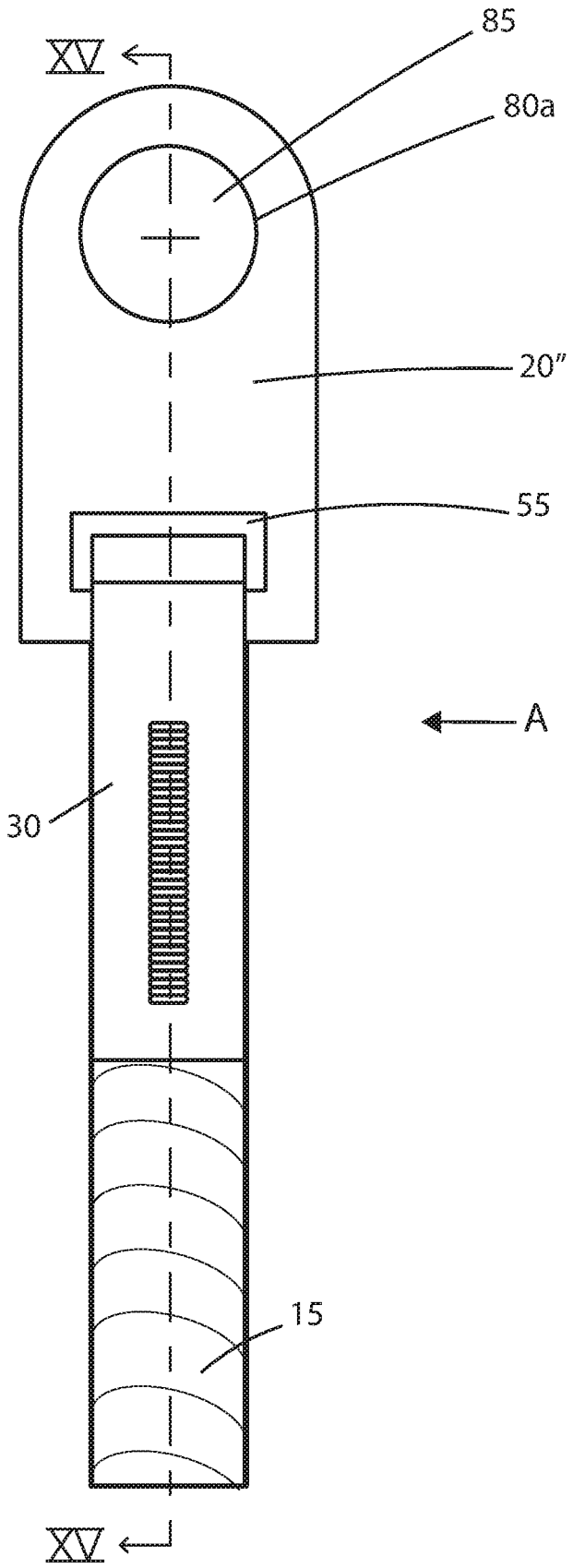

FIGS. 13-14 show a perspective view and front view respectively of a belt with third buckle 20". The third buckle 20" may be used as the buckle of the belt 10 of FIG. 1.

Figure 15:
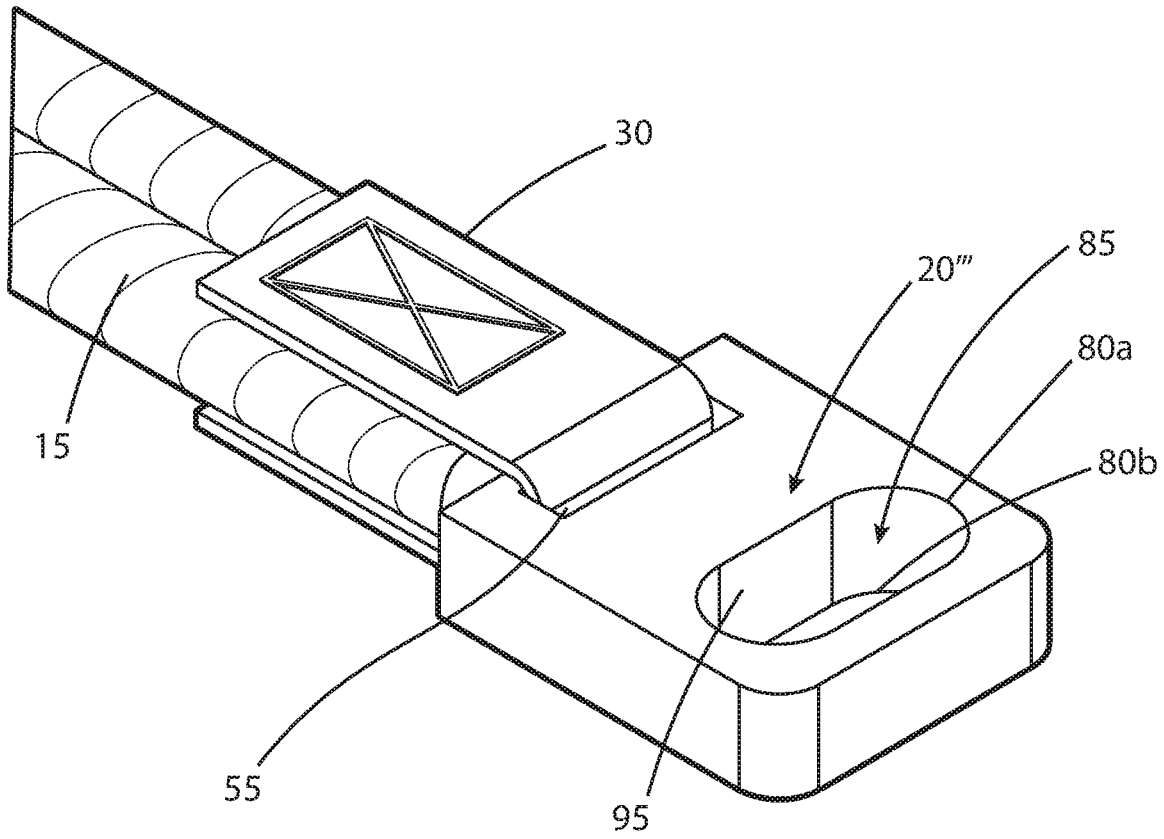
FIGS. 15-16 show a perspective view and front view respectively of the belt of FIG. 2 using a fourth buckle.
Figure 16:
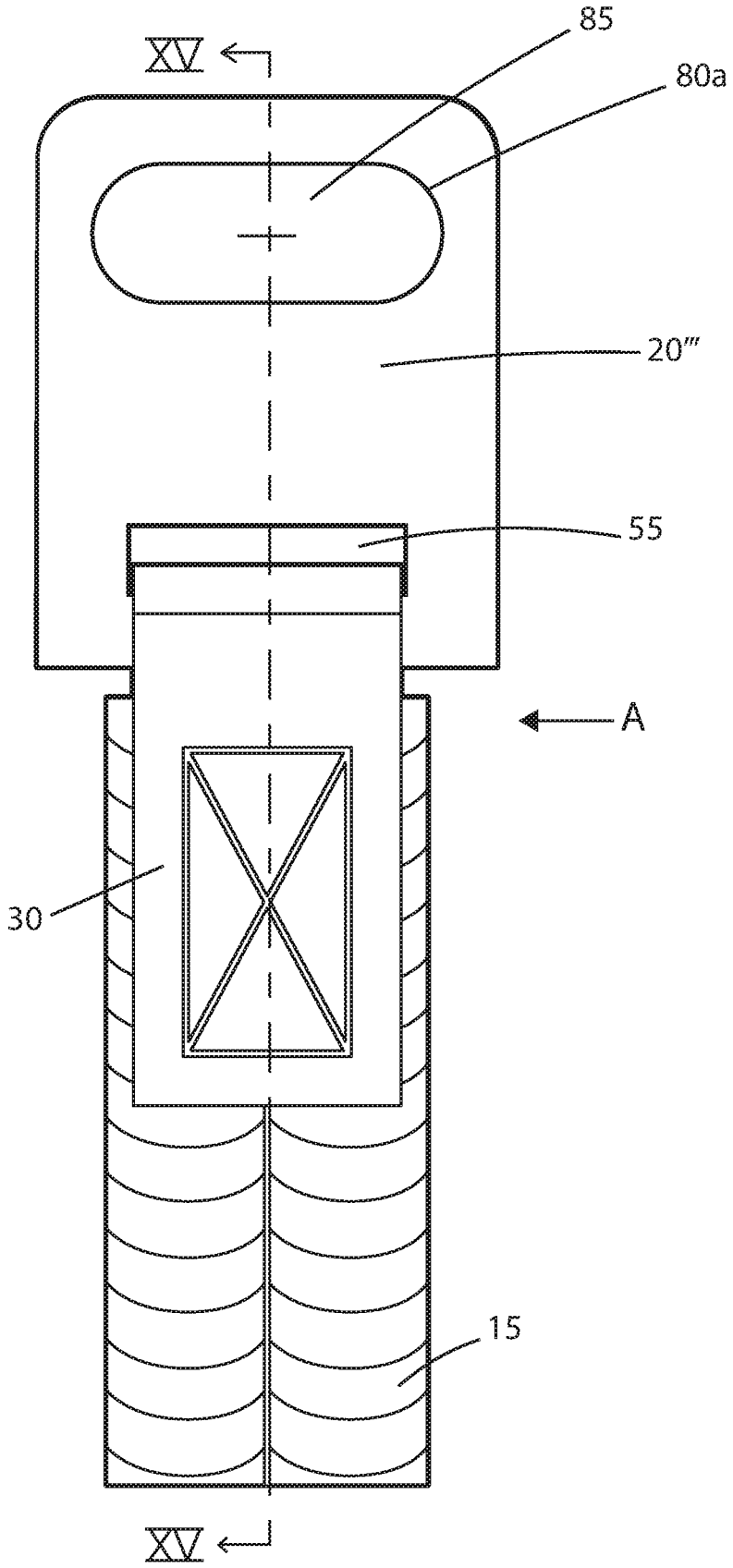
Figure 17:
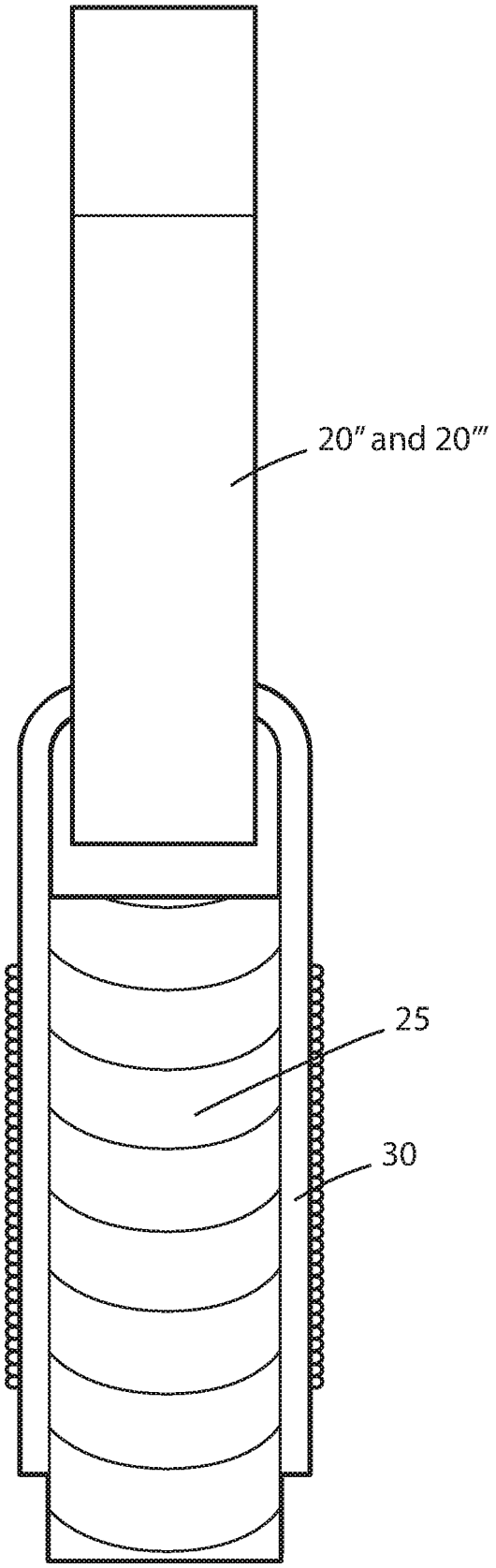
FIGS. 17-22 show aspects of buckles that may be used with the belt of FIG. 1 or the belt of FIG. 2.
Figure 18:
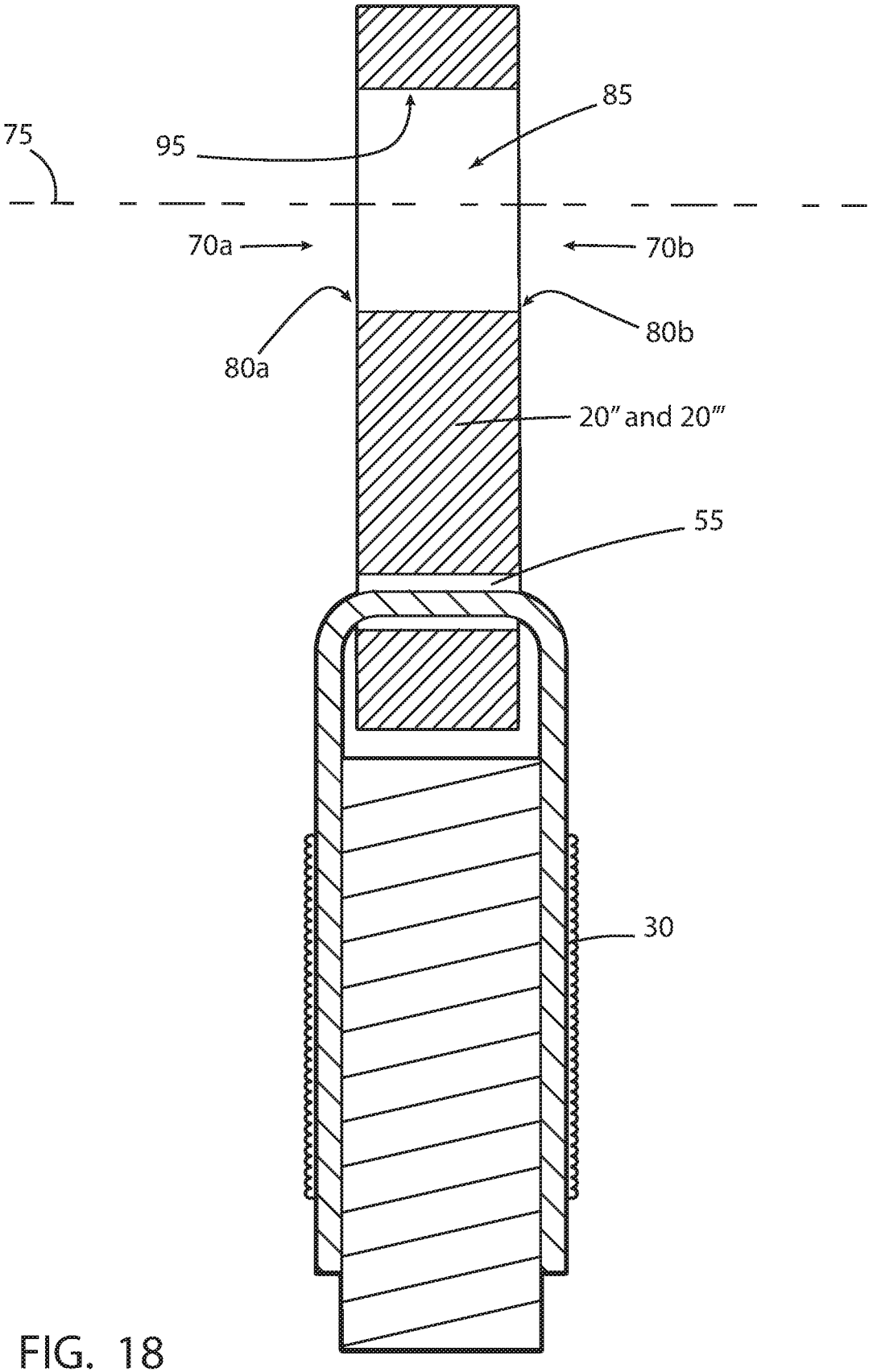

FIGS. 15-16 show a perspective view and front view respectively of a belt with fourth buckle 20'". The third buckle 20" may be used as the buckle of the belt 10' of FIG. 2.

FIGS. 17-22 show an embodiment of the belt 10 and 10' with buckle 20" and buckle 20'" in accordance with aspects of the invention. As shown in FIGS. 17-22, the belt 10 and 10' comprises the cord 15, attachment 30, and buckle 20" and buckle 20'".

In each of the buckles described herein (e.g., buckle 20, buckle 20', buckle 20", and buckle 20"), the buckle may comprise a body that defines an eyelet 50 and an opening 55, the opening 55 being used with attachment 30 as described herein.

In embodiments, a length of the buckle 20, 20', 20" and 20'" as measured from an axis 75 of the eyelet 50 to the hinge axis 86 of the buckle is 0.25 inches to 2.0 inches (as shown by "L" in FIGS. 24, 26, 30 and 32). Additionally, a hinge point this hinge axis 86 advantageously urges the buckle into the locked position when a user applies a tension force to portions of the cord 15 on opposite sides of the buckle 20 with the distal end of the cord 15 positioned through the opening. This hinging and urging of the buckle and cord into the locked position (in response to the user pull force) contributes to a self-locking feature of the belt 10 and belt 10'.

In accordance with aspects of the invention, the eyelet 50 is an opening through the buckle 20 (and its other embodiments) that the distal end 35 of the cord 15 is designed and configured to pass through and be selectively locked, by the locking feature, relative to the buckle 20. The eyelet 50 is shown in the figures as a circular opening. However, the eyelet 50 may have other shapes provided that the shape achieves the selective locking and unlocking as described herein. In some embodiments, the eyelet 50 is a circular opening and the diameter of the eyelet 50 is substantially equal to the outer diameter of the cord 15 (e.g., plus or minus 0% to 5% difference in the diameters). In this manner, the cord 15 fills essentially the entire eyelet 50 when the cord 15 is positioned in the eyelet 50 in the unlocked position. In this exemplary embodiment, these matching dimensions provide the advantage of producing a static friction force between the cord 15 and the buckle 20 when the distal end 35 of the cord 15 is positioned in the eyelet 50 of the buckle 20 in the unlocked position. This static friction force (in the unlocked position) is of sufficient magnitude to prevent the distal end 35 of the cord 15 from slipping or moving in the eyelet 50 under its own weight, but is also sufficiently small that it is easily overcome by a user applying a pushing or pulling force to move the cord 15 within the buckle 20. This differentiates embodiments of the invention from traditional belts in which a diameter of an opening of an eyelet is much larger than an outside diameter of a material passing through the eyelet, since such traditional belts do not have the degree of static friction described herein.

According to aspects of the invention, the eyelet 50 comprises teeth 65 on opposite sides 70*a* and 70*b* of the eyelet 50. In embodiments, the teeth 65 on each side are arranged concentrically around an axis 75 that defines the center the eyelet 50. In embodiments, the teeth 65 on each side have equal size with one another and equal spacing between one another. In the example shown, each side has fifteen teeth 65, although other numbers of teeth 65 may be used.

In embodiments, the teeth 65 protrude outward from a convex surface that defines the opening of the eyelet 50. In particular embodiments, the teeth 65 do not extend into a circular area defined by the eyelet 50. For example, as shown in FIG. 4, there can be a gap 80 between the radial extent of each tooth and the circular area defined by the eyelet 50. In this manner, when viewed along the axis 75 (as shown in FIG. 4), the innermost portions of the teeth 65 define a circle that is equal to or larger diameter than that of the opening 50. Due to this design, the cord 15 may be selectively positioned (i.e., as shown in FIGS. 9 and 10) to pass through the opening 50 while contacting the crown of the convex surface that defines the eyelet 50, but without contacting the teeth 65. In this manner, the cord 15 may be selectively positioned (i.e., as shown in FIGS. 9 and 10) to pass through the eyelet 50 while only being hindered by the friction between the cord 15 and the smooth crown of the convex surface that defines the eyelet 50, but without contacting the teeth 65. In this way, when the cord 15 is positioned with its long axis 77 (of the part of the cord 15 within and around the eyelet 50) parallel to the axis 75 of the circular opening, and without bending into contact with the teeth 65, the cord 15 may pass relatively easily through the buckle 20 (i.e., in an unlocked position, as shown in FIGS. 9 and 10).

With reference now to FIGS. 11 and 12, after the distal end 35 of the cord 15 is passed through the eyelet 50 of the buckle 20, the cord 15 may be bent to a locked position in which the cord 15 engages one or more of the teeth 65. This engagement between the cord 15 and the teeth 65 increases the friction between the cord 15 and the eyelet 50 (e.g., provides a greater amount of friction relative to the unlocked position shown in FIGS. 9 and 10), and prevents movement of the cord 15 through the eyelet 50. In this way, when the cord 15 is positioned with its long axis 77 (of the part of the cord 15 within and around the eyelet 50) non-parallel to the axis 75 of the eyelet 50, the cord 15 engages at least one of the teeth 65 and is prevented from passing through the buckle 20 (i.e., in an locked position, as shown in FIGS. 11 and 12). In embodiments, the system is structured and arranged so that the cord 15 engages at least one of the teeth 65 when the axis 77 is angled at 15° or more relative to axis 75. In embodiments, the material of the buckle 20, including the teeth 65, the geometry of the teeth 65, and the material and geometry of the cord 15 are designed together such that, when the belt 10 is in the locked position, the belt 10 withstands a pull force of 100 lbf (pound-force), meaning that the belt 10 will not permit the cord 15 to slide through the buckle's eyelet 50 when a tension force of up to 100 lbf is applied.

As should be understood from the description thus far, a user may use the belt 10 in the following manner. First, with the distal end 35 not yet passing through the buckle 20, the user wraps the belt 10 around their waist, e.g., through belt loops in a garment such as pants, shorts, etc. The user then passes the distal end 35 through the eyelet 50 in the buckle 20 while the cord 15 is in the unlocked position. The user continues moving the cord 15 through the buckle 20 until the user finds the desired snugness of the belt 10. The user then bends the distal end 35 of the cord 15 relative to the buckle 20 to put the cord 15 in the locked position. Additionally or alternatively to the user bending the distal end 35 by manually moving the distal end 35 relative to the buckle 20, the user may also place the belt into the locked position by grasping intermediate portions of the cord 15 on opposite sides of the buckle 20 and pulling these portions in opposite directions away from the buckle 20; the force provided by this pulling, combined with the arrangement of the proximal end attached to the buckle 20 and being hinged by the opening 55 of the buckle 20 causes a portion of the cord 15 in and around the opening to bend into a position where the cord 15 engages the edge (80*a* or 80*b*) or one or more of the teeth 65 of the eyelet 50. In this manner, the apparatus includes a self-locking functionality. The user may adjust the snugness of the belt 10 at any time by moving the cord 15 to the unlocked position, and then moving the distal end 35 forward or backward through the buckle 20. In this manner, the belt 10 is infinitely adjustable, and is not limited to a discrete number of sizes. After finding the desired snugness and arranging the cord 15 in the locked position, the user may stow the remainder of the distal end 35 by, for example, tucking it into an adjacent belt loop, tucking it into or around a portion of the cord 15, or may let the distal end 35 hang down freely. To remove the belt 10, the user moves the cord 15 to the unlocked position and then pulls the distal end 35 backward through the buckle 20 such that the cord 15 is no longer passing through the buckle 20.

FIGS. 13-22 show an embodiment where the cord 15 and attachment 30 are the same as those previously described in the first embodiment. In the second embodiment shown in FIGS. 13-22, the buckle 20" and buckle 20" differs from the buckle 20 and the buckle 20' in that the locking feature of the buckle 20" and the buckle 20'" comprises two edges 80*a* and 80*b* (shown in FIG. 13) instead of plural teeth arranged concentrically around each side of the opening. In particular, as shown in FIGS. 13 and 15, the buckle 20" comprises an eyelet that defines the opening for the distal end 35 of the cord 15 to pass through. In embodiments, the eyelet 50 comprises a circular sidewall 95 that is symmetric about the axis 75 of the bore 85. The intersection of the sidewall 95 and the two opposed outer surfaces of the buckle 20'" form edges 80*a* and 80*b*. The eyelet bore 85 is shown in the figures as a circular opening. However, the eyelet 85 may have other shapes provided that the shape achieves the selective locking and unlocking as described herein.

Figure 19:
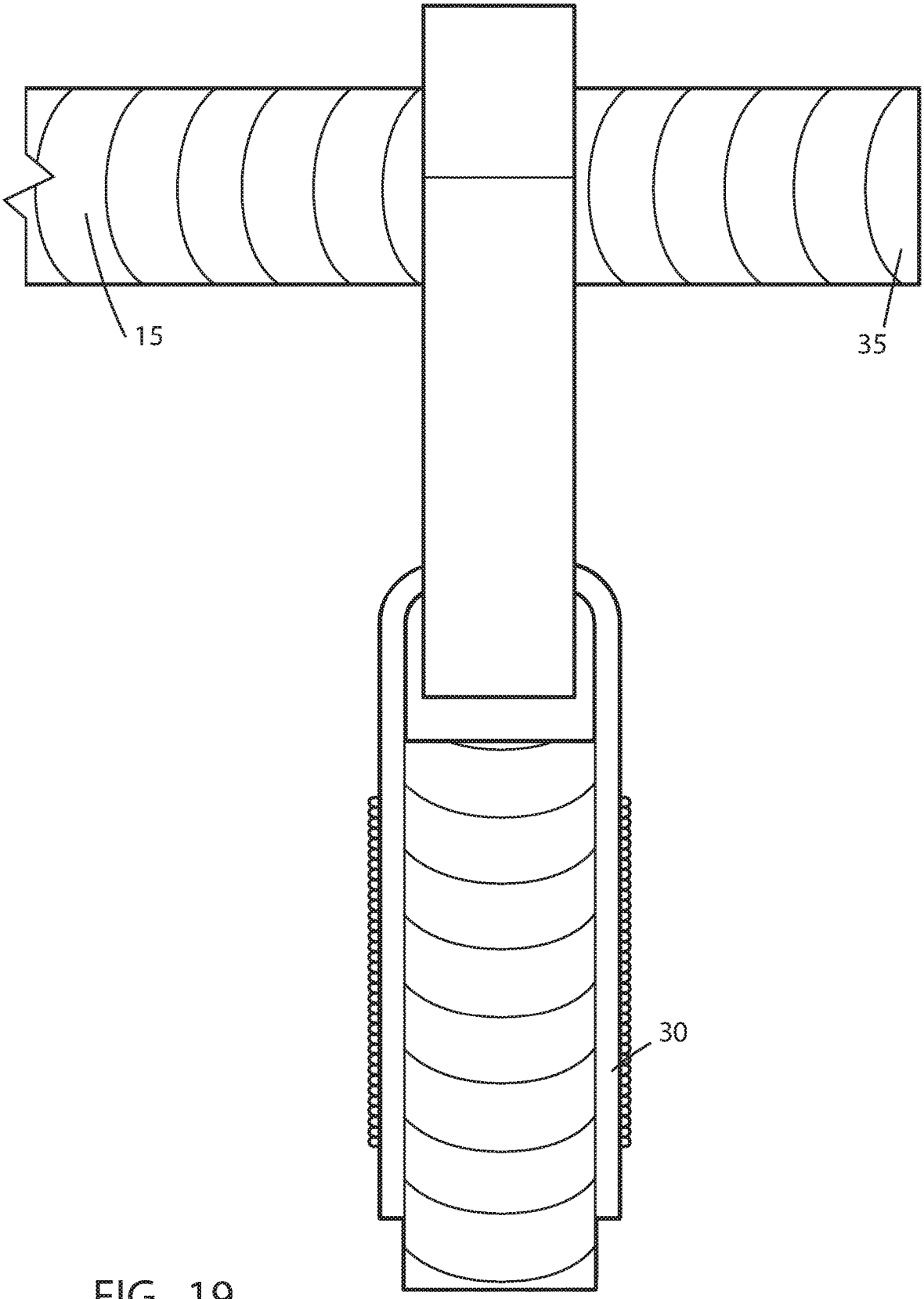
Figure 20:
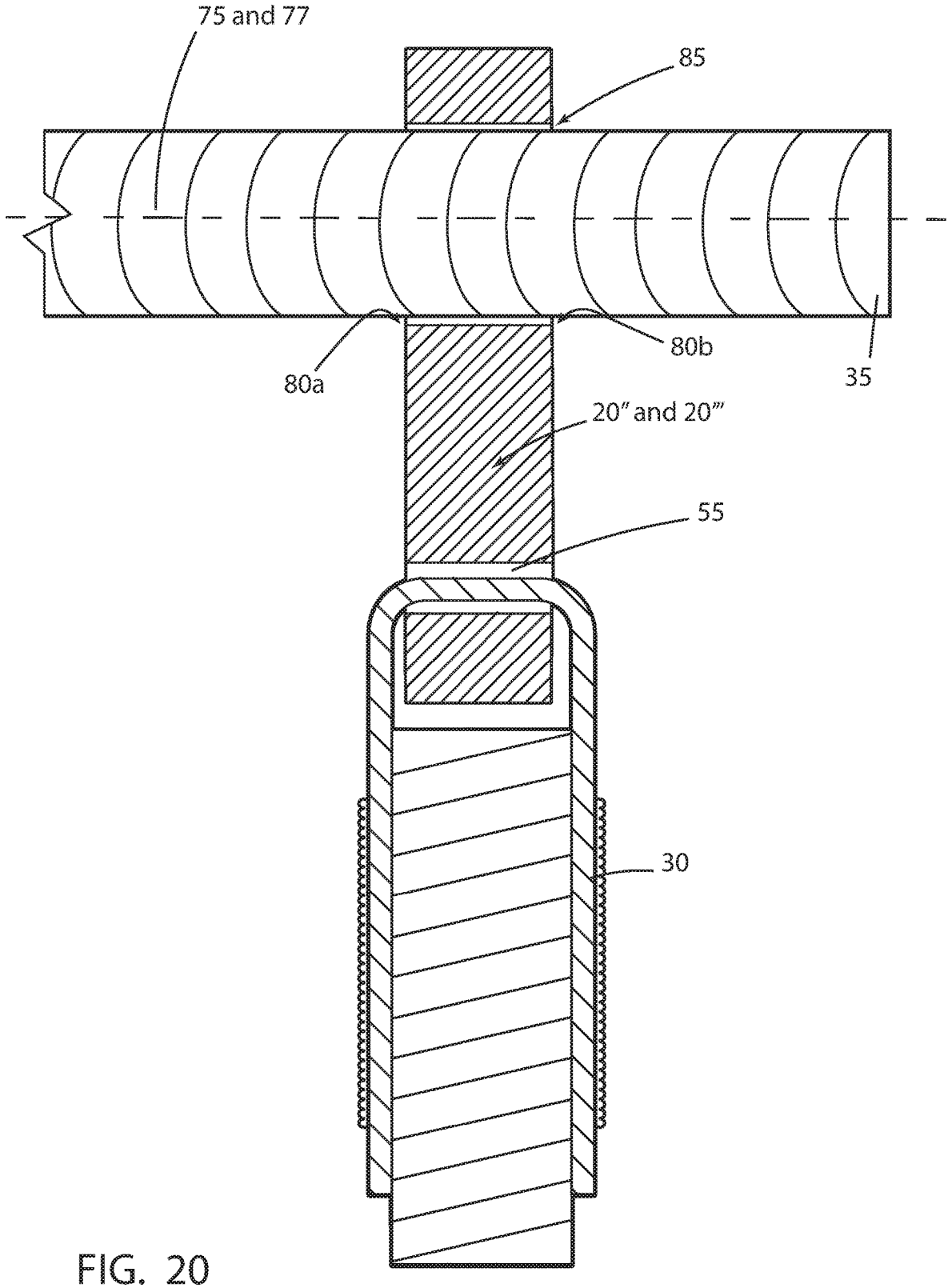

In this manner, when the cord 15 is positioned with its long axis 77 (of the part of the cord 15 within and around the eyelet 85) parallel to the axis 75 of the eyelet 85, and without bending into contact with the edges 80*a*, 80*b*, the cord 15 may pass relatively easily through the bore 85 (i.e., in an unlocked position, as shown in FIGS. 19 and 20).

Figure 21:
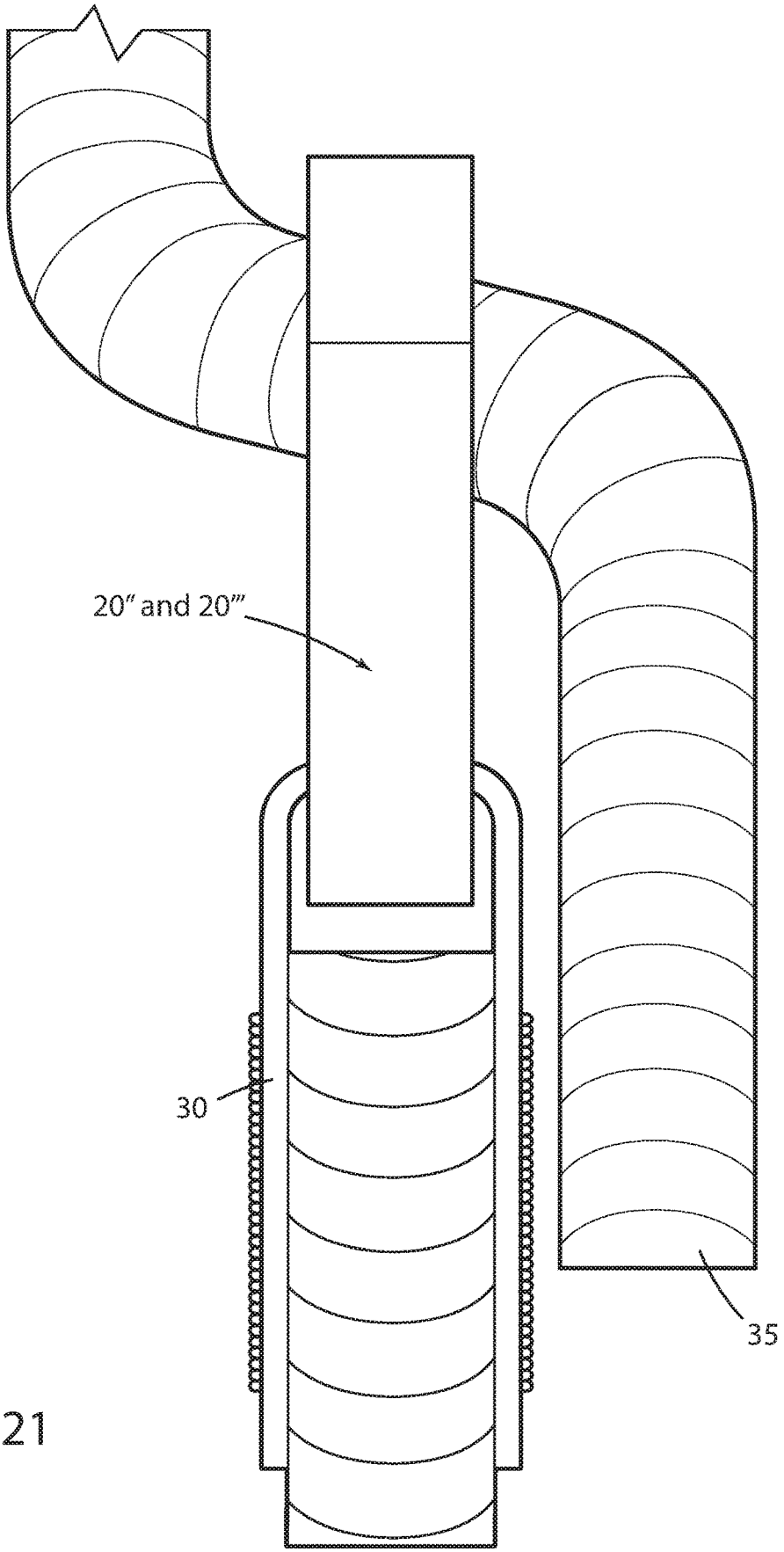
Figure 22:
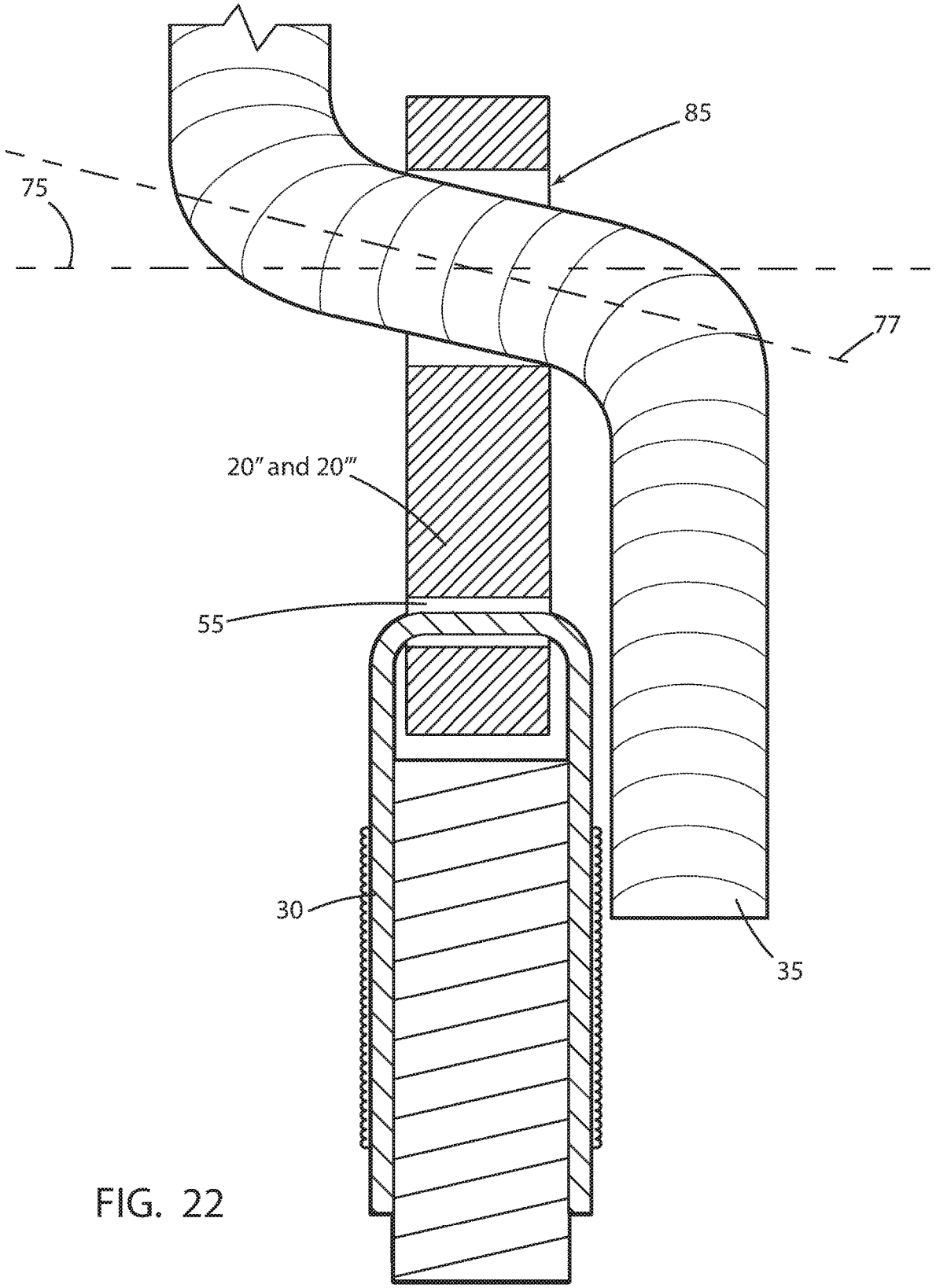

With reference now to FIGS. 21 and 22, after the distal end 35 of the cord 15 is passed through the eyelet 85 of the buckle 20", the cord 15 may be bent to a locked position in which the cord 15 engages one or more of the edges 80*a*, 80*b*. As with the previous embodiment, the locking may be accomplished by manually moving the distal end of the cord relative to the buckle, or by grasping portions of the cord on either side of the buckle and pulling the grasped portions of the cord away from the buckle which causes the cord to bend relative to the buckle and engage the locking feature in a self-arresting manner. This engagement between the cord 15 and the edges 80*a*, 80*b* increases the friction between the cord 15 and the buckle 20" (e.g., provides a greater amount of friction relative to the unlocked position shown in FIGS. 16 and 17), and prevents movement of the cord 15 through the eyelet 85. In this way, when the cord 15 is positioned with its long axis 77 (of the part of the cord 15 within and around the eyelet 85) non-parallel to the axis 75 of the eyelet 85, the cord 15 engages at least one of the edges 80*a*, 80*b* and is prevented from passing through the buckle 20" (i.e., in an locked position, as shown in FIGS. 21 and 22).

In embodiments, the buckle 20'" is similar to the buckle 20" except that buckle 20'" has an eyelet 50 that is sized and shaped to correspond to more than one portion of cord 15. In the example shown in FIGS. 2, 15, and 16, the belt 10' comprises a double-portion of cord 15, and the buckle 20'" has an eyelet 50 that is sized and shaped to receive the double-portion of cord 15, and to selectively lock the double-portion of cord 15, in a similar manner as that described with respect to buckle 20" that is configured to be used with a single portion of cord 15.

Figure 23:
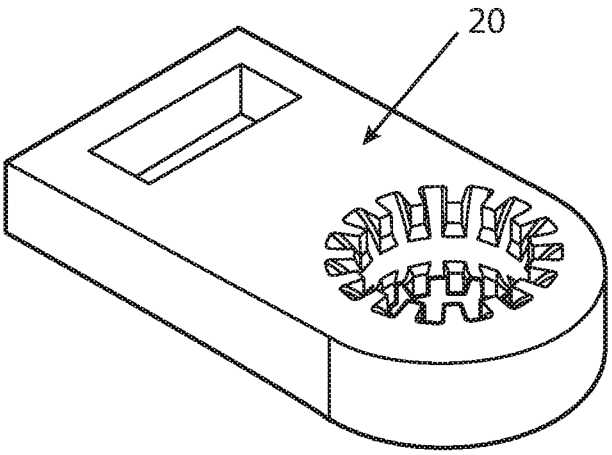
FIGS. 23-24 show aspects of the first buckle in accordance with embodiments of the invention.
Figure 24:
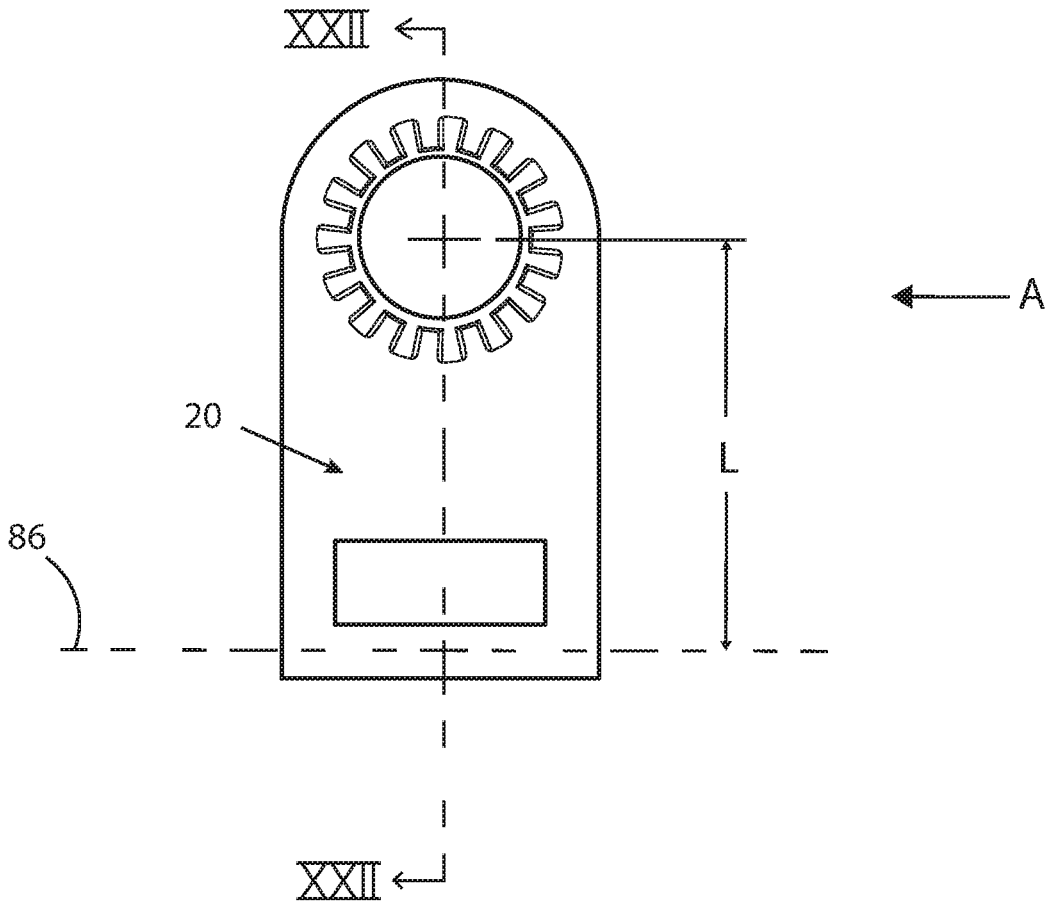
Figure 25:
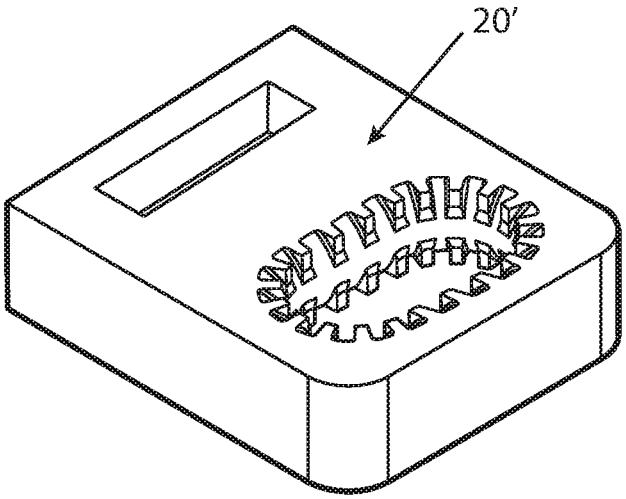
FIGS. 25-26 show aspects of the second buckle in accordance with embodiments of the invention.
Figure 26:
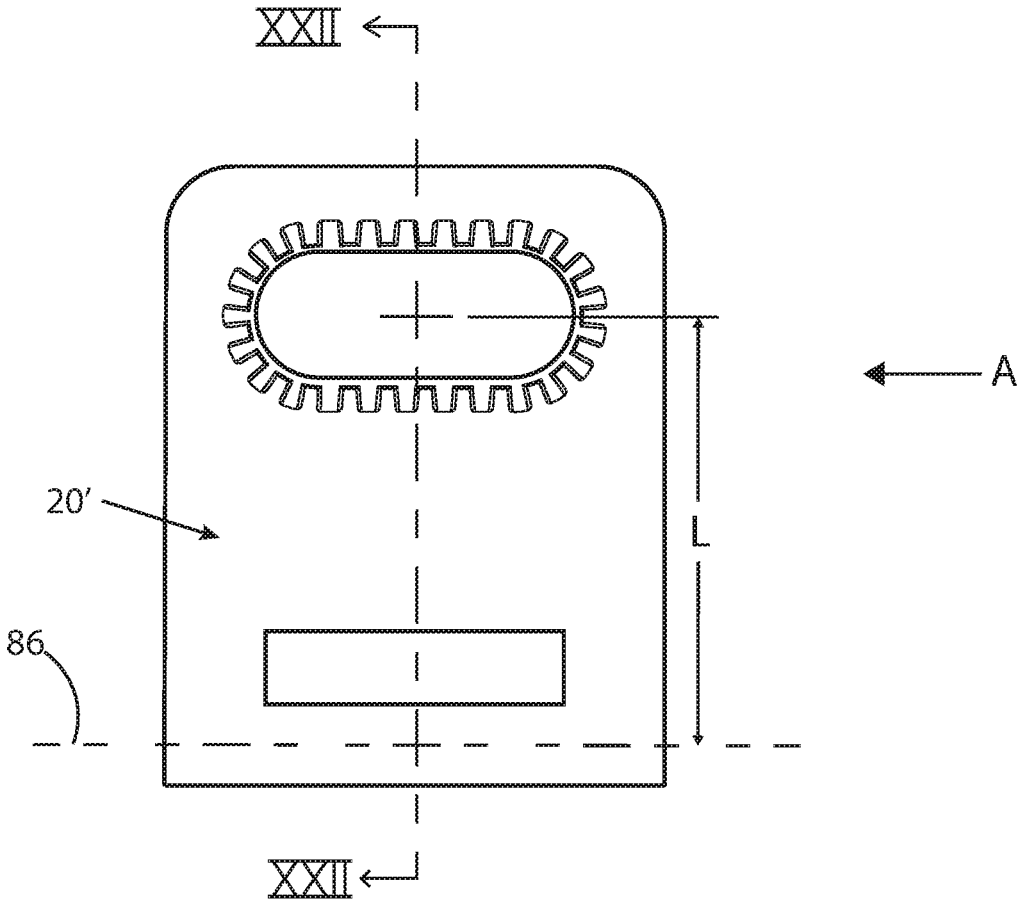
Figure 27:
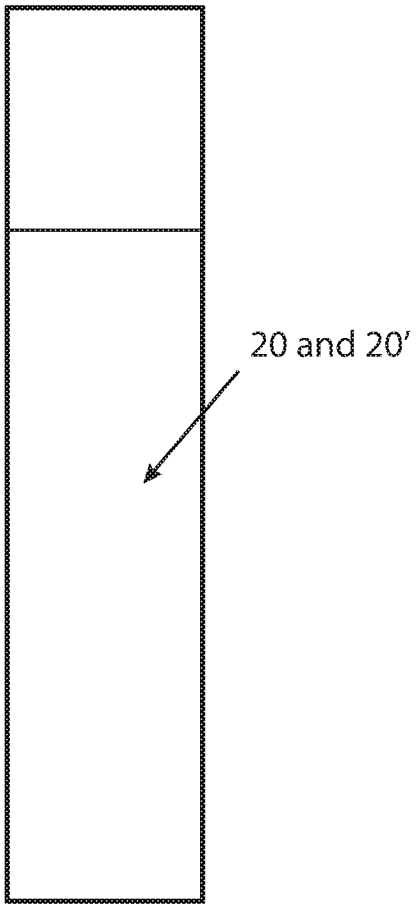
FIGS. 27-28 show an exemplary cross section that is representative of both the first buckle and the second buckle.
Figure 28:
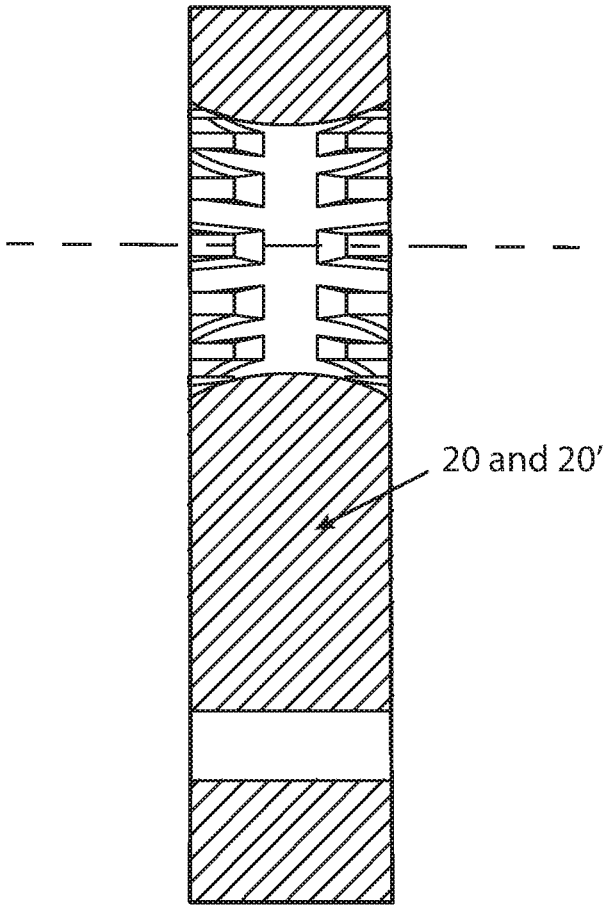

FIGS. 23-34 show the buckle in accordance with aspects of the invention. FIG. 23 shows a perspective view of the buckle 20. FIG. 24 shows as front view of the buckle 20. FIG. 27 shows a side view of the buckle 20 and 20' viewed in the direction of arrow A shown in FIG. 26. FIG. 28 shows a side cutaway view of the buckle 20 and 20' along plane XXII-XXII.

Figure 29:
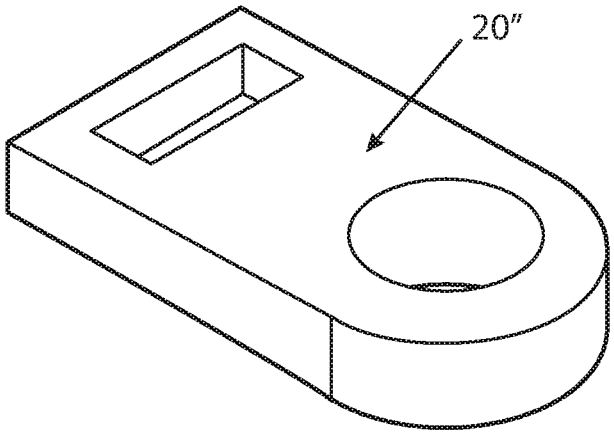
FIGS. 29-30 show aspects of the third buckle in accordance with embodiments of the invention.
Figure 30:
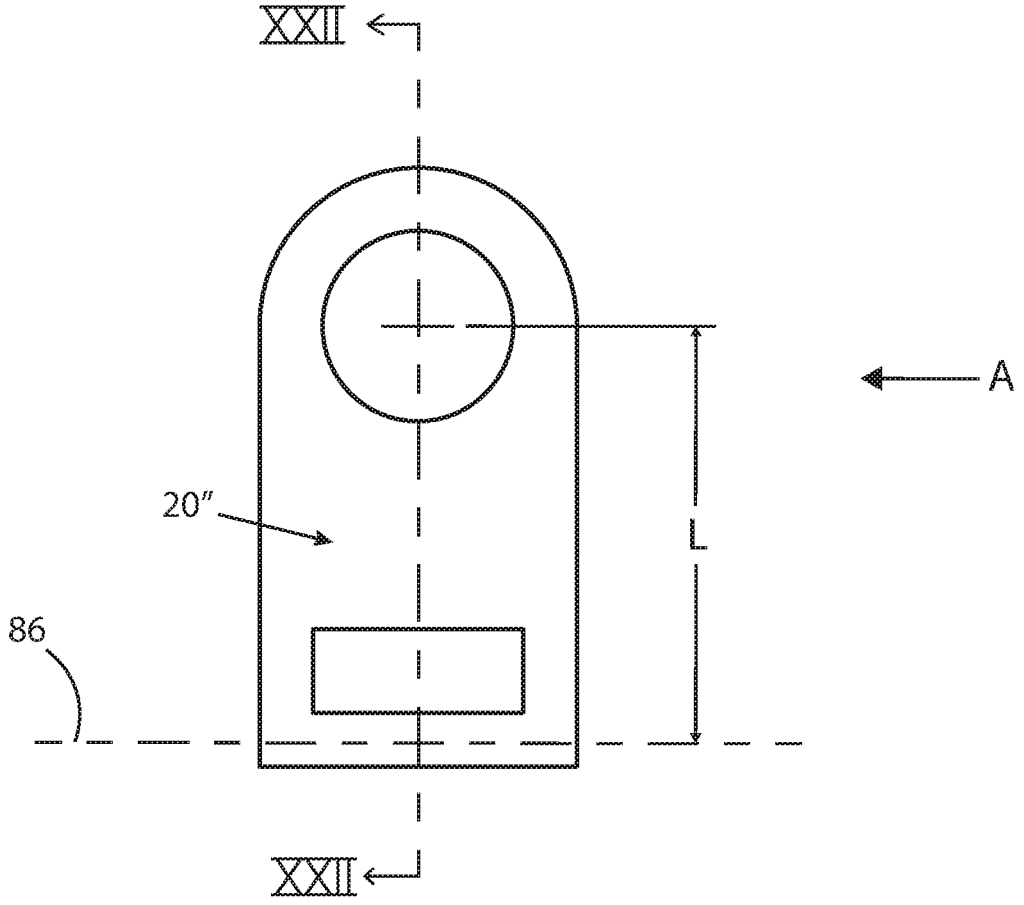
Figure 31:
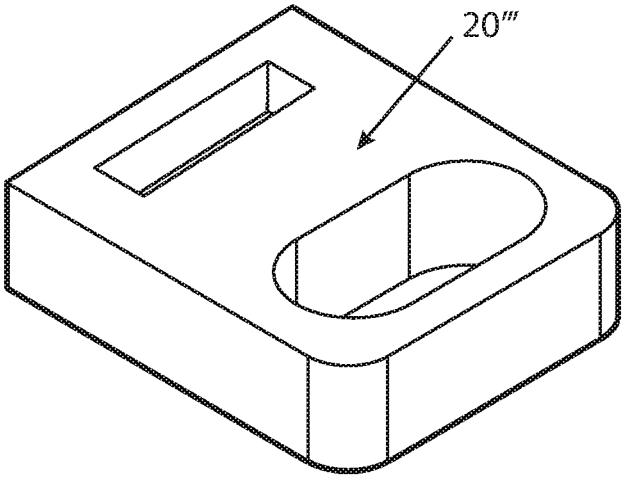
FIGS. 31-32 show aspects of the fourth buckle in accordance with embodiments of the invention.
Figure 32:
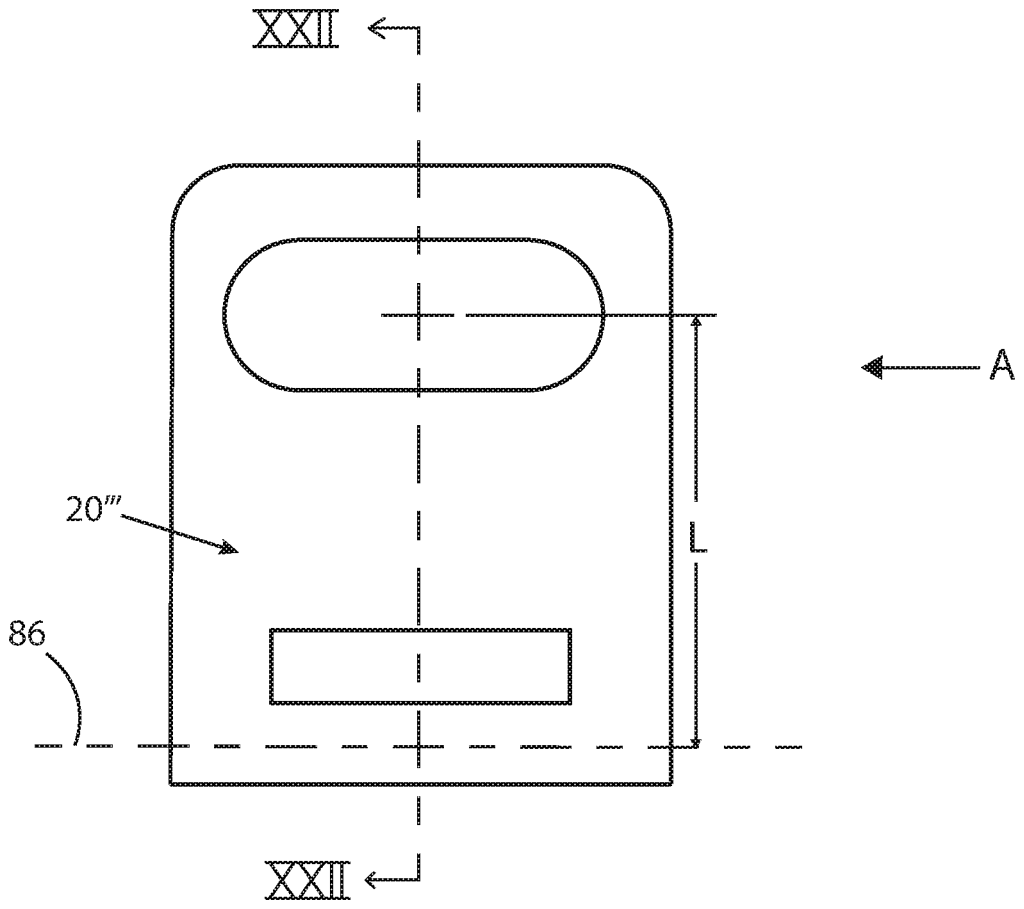
Figure 33:
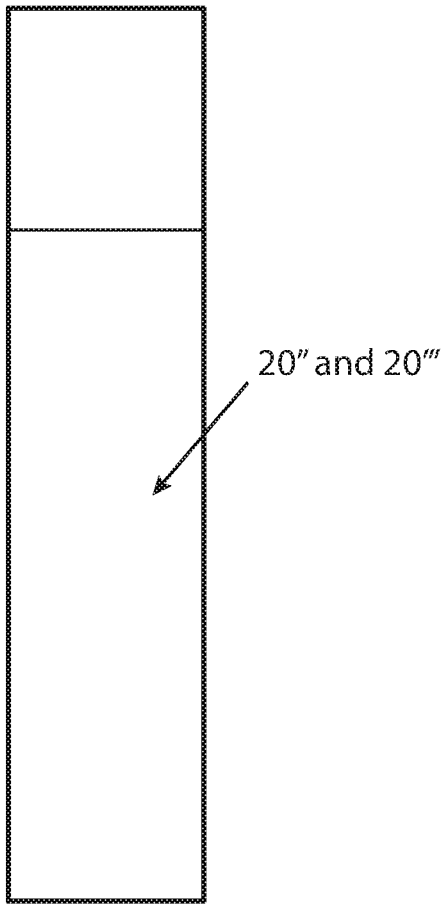
FIGS. 33-34 show an exemplary cross section that is representative of both the third buckle and the fourth buckle
Figure 34:
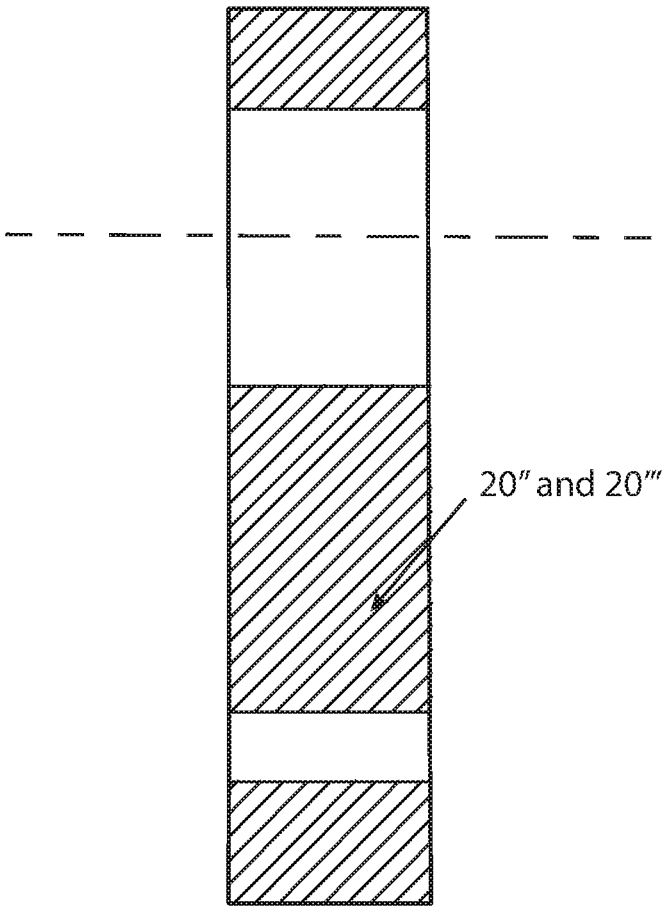

FIGS. 29-34 show the buckle 20" and 20'" in accordance with aspects of the invention. FIG. 29 shows a perspective view of the buckle 20". FIG. 30 shows as front view of the buckle 20". FIG. 33 shows a side view of the buckle 20" and 20'" viewed in the direction of arrow A shown in FIG. 26. FIG. 34 shows a side cutaway view of the buckle 20" and 20'" along plane XXVII-XXVII.

It is noted that the foregoing examples have been provided merely for the purpose of explanation and are in no way to be construed as limiting aspects of the present invention. While aspects of the present invention have been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although aspects of the present invention have been described herein with reference to particular means, materials and embodiments, aspects of the present invention are not intended to be limited to the particulars disclosed herein; rather, aspects of the present invention extend to all functionally equivalent structures, methods and uses, such as are within the scope of the appended claims.

What is claimed:

1. An apparatus, comprising:

a cord comprising a proximal end and a distal end; and a buckle comprising an eyelet and a locking feature, wherein the proximal end of the cord is attached to the buckle;

the distal end of the cord is configured to pass through the buckle, wherein the cord and the buckle combine to form a continuous closed loop when the distal end of the cord is passed through the buckle;

the locking feature is structured and arranged to selectively lock and unlock movement of the cord through the eyelet;

the buckle is configured such that the cord can pass through the buckle no more than a single time, the eyelet is symmetric across at least two planes that intersect and are parallel to a central axis of the eyelet; and the apparatus comprises a belt.

2. The apparatus of claim 1, wherein the buckle is a unitary structure and has no moving parts and is attached to the proximal end of the cord via a hinged connection.

3. The apparatus of claim 1, wherein the cord and the buckle are structured and arranged with relative sizes such that:

the cord is disengaged from the locking feature and in an unlocked position relative to the buckle when the cord is positioned within the eyelet with its long axis parallel to an axis of the eyelet; and the cord is engaged with the locking feature and in a locked position relative to the buckle when the cord is positioned within the eyelet with its long axis non-parallel to the axis of the eyelet.

4. The apparatus of claim 1, wherein the eyelet is circular.

5. The apparatus of claim 1, wherein the cord and the buckle are structured and arranged with relative sizes such that only a single portion of the cord fits inside the eyelet at one time.

6. The apparatus of claim 1, wherein an outside diameter of the cord is substantially equal to a diameter of the eyelet.

7. The apparatus of claim 1, wherein the locking feature comprises plural teeth around the eyelet.

8. The apparatus of claim 7, wherein the plural teeth comprise:

a first set of teeth circumferentially around a first side of the eyelet; and a second set of teeth circumferentially around a second side of the eyelet.

9. The apparatus of claim 7, wherein the plural teeth protrude outward from a convex surface that defines a circular eyelet.

10. The apparatus of claim 9, wherein the plural teeth do not extend into a circular area defined by a crown of the convex surface.

11. The apparatus of claim 1, wherein:

the eyelet is defined by a through-bore with a sidewall that is symmetric about a plane through the center of the buckle and normal to the axis centerline of the eyelet; and the locking feature comprises an edge defined by an intersection of the sidewall and two opposed outer surfaces of the eyelet.

12. The apparatus of claim 1, wherein the cord comprises a rope having a core and a braided sheath around the core.

13. The apparatus of claim 1, wherein:

the buckle is a unitary structure and has no moving parts and is attached to the proximal end of the cord via a rigid connection.

14. The apparatus of claim 1, wherein the proximal end of the cord is attached to the buckle by an attachment that passes through an opening in the buckle, the opening being separate from the eyelet.

15. The apparatus of claim 14, wherein the attachment is connected between the buckle and the proximal end of the cord such that the proximal end of the cord is not directly attached to the buckle.

16. The apparatus of claim 1, wherein the buckle is configured such that the cord can pass no more than a single time through a boundary defined by a plane that is normal to an axis of the eyelet, centered to the buckle, and a perimeter defined by the outermost geometry projection of the buckle onto the plane.

17. An apparatus, comprising:

a cord comprising a proximal end and a distal end; and a buckle comprising an eyelet and a locking feature, wherein the cord is configured to pass through the eyelet, wherein the locking feature is structured and arranged to selectively lock and unlock movement of the cord through the eyelet;

the buckle is a unitary structure and has no moving parts;

the buckle is configured to allow the cord to pass through the buckle no more than a single time; and the apparatus comprises a belt.

18. The apparatus of claim 17, wherein:

the locking feature comprises plural teeth comprising: a first set of teeth circumferentially around a first side of the eyelet; and a second set of teeth circumferentially around a second side of the eyelet; and the plural teeth protrude outward from a convex surface that defines the eyelet.

19. The apparatus of claim 17, wherein:

the eyelet is defined by a through-bore with a sidewall that is symmetric about a plane that is center to the buckle and normal to the axis centerline of the eyelet; and the locking feature comprises edges defined by an intersection of the sidewall and two opposed outer surfaces of the buckle.

20. An apparatus, comprising:

a cord comprising a proximal end and a distal end; and a buckle comprising an eyelet and a locking feature, wherein the proximal end of the cord is attached to the buckle;

the distal end of the cord is configured to pass through the eyelet, wherein the cord and the buckle combine to form a continuous closed loop when the distal end of the cord is passed through the buckle;

the locking feature engages the cord and locks the cord relative to the buckle when the cord is positioned within the eyelet with its long axis non-parallel to an axis of the eyelet;

the buckle is configured to allow the cord to pass through the buckle no more than a single time; and the apparatus comprises a belt.

* * * * *